US009758877B2

(12) United States Patent
Esposito et al.

(10) Patent No.: US 9,758,877 B2
(45) Date of Patent: Sep. 12, 2017

(54) COMPOSITIONS AND METHODS FOR INHIBITING CORROSION IN GAS TURBINE AIR COMPRESSORS

(71) Applicant: General Electric Company, Schenectady, NY (US)

(72) Inventors: Sal Esposito, Trevose, PA (US); Anthony M. Rossi, Trevose, PA (US); Mel Joseph Esmacher, The Woodlands, TX (US); Rebecca Evelyn Hefner, Fountain Inn, SC (US); Trevor James Dale, Metuchen, NJ (US); Kelsey Elizabeth Beach, Atlanta, GA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 14/769,499

(22) PCT Filed: Feb. 28, 2014

(86) PCT No.: PCT/US2014/019521
§ 371 (c)(1),
(2) Date: Aug. 21, 2015

(87) PCT Pub. No.: WO2014/134491
PCT Pub. Date: Sep. 4, 2014

(65) Prior Publication Data

US 2016/0002793 A1 Jan. 7, 2016

Related U.S. Application Data

(60) Provisional application No. 61/771,416, filed on Mar. 1, 2013.

(51) Int. Cl.
*C23G 1/00* (2006.01)
*C23F 11/00* (2006.01)
(Continued)

(52) U.S. Cl.
CPC ..... *C23F 11/00* (2013.01); *B08B 3/08* (2013.01); *C23F 11/141* (2013.01); *F24F 7/00* (2013.01)

(58) Field of Classification Search
CPC ..... C23F 11/00; C23F 11/141; B08B 3/08; F24F 7/00
See application file for complete search history.

(56) References Cited

U.S. PATENT DOCUMENTS 2,759,021 A 8/1956 Gaar et al.
3,025,313 A 3/1962 Gunderson et al.
(Continued)

FOREIGN PATENT DOCUMENTS

CN 102330106 A 1/2012
EP 0275987 A2 7/1988
(Continued)

OTHER PUBLICATIONS

A Office Action issued in connection with corresponding CN Application No. 201480011913.1 on Aug. 4, 2016.
(Continued)

*Primary Examiner* — Bibi Carrillo
(74) *Attorney, Agent, or Firm* — Wegman, Hessler & Vanderburg

(57) ABSTRACT

Methods and compositions are disclosed for inhibiting corrosion on metal surfaces of gas turbine air compressors. The methods comprise contacting the metal surfaces with a corrosion inhibiting composition comprising at least one filming amine.

4 Claims, 18 Drawing Sheets

(51) Int. Cl.

| | |
|---|---|
| ***C23F 11/14*** | (2006.01) |
| ***B08B 3/08*** | (2006.01) |
| *F24F 7/00* | (2006.01) |

(56) References Cited

U.S. PATENT DOCUMENTS

| | | | | |
|---|---|---|---|---|
| 3,203,904 | A * | 8/1965 | Brown | C23F 11/142 134/22.14 |
| 3,687,859 | A * | 8/1972 | Silverstein | C23F 11/141 134/2 |
| 3,860,430 | A * | 1/1975 | Walker | C09D 5/08 106/14.15 |
| 4,276,089 | A | 6/1981 | Moran | |
| 4,562,042 | A | 12/1985 | Moran | |
| 4,657,785 | A * | 4/1987 | Kelly | C23F 11/149 106/14.15 |
| 4,704,208 | A | 11/1987 | Bouet | |
| 4,895,696 | A | 1/1990 | Bellows | |
| 5,076,855 | A * | 12/1991 | Kaes | C11D 1/40 134/19 |
| 5,173,213 | A | 12/1992 | Miller et al. | |
| 5,279,760 | A * | 1/1994 | Sato | C11D 3/2068 510/109 |
| 5,368,775 | A | 11/1994 | Rossi et al. | |
| 6,326,336 | B1 | 12/2001 | Gatto et al. | |
| 6,430,249 | B2 | 8/2002 | Egerbrecht et al. | |
| 6,881,244 | B2 | 4/2005 | Liebig et al. | |
| 8,250,931 | B2 | 8/2012 | Young et al. | |
| 2002/0103093 | A1* | 8/2002 | LaGraff | B08B 3/12 510/185 |
| 2002/0129837 | A1* | 9/2002 | Ruiz | C23G 1/00 134/18 |
| 2002/0148488 | A1* | 10/2002 | Jeutter | C23G 5/00 134/28 |
| 2006/0180794 | A1 | 8/2006 | Goddard et al. | |
| 2006/0231123 | A1* | 10/2006 | Cox | C23F 1/44 134/26 |
| 2009/0291865 | A1 | 11/2009 | Brennan et al. | |
| 2010/0037777 | A1 | 2/2010 | Davis | |
| 2010/0037924 | A1* | 2/2010 | Gebhardt | F01D 25/002 134/115 R |
| 2010/0326466 | A1* | 12/2010 | Kawakami | F01D 5/005 134/3 |
| 2011/0083701 | A1 | 4/2011 | Esmacher et al. | |
| 2014/0102482 | A1* | 4/2014 | Ramminger | C23F 11/141 134/18 |

FOREIGN PATENT DOCUMENTS

| | | | |
|---|---|---|---|
| EP | 0994175 | A2 | 4/2000 |
| EP | 1045045 | A1 | 10/2000 |
| EP | 1129038 | A1 | 4/2003 |
| EP | 1418253 | A1 | 5/2004 |
| EP | 1557539 | A1 | 7/2005 |
| GB | 1095865 | | 12/1967 |
| GB | 1354753 | * | 8/1971 |
| GB | 2064985 | A | 6/1981 |
| GB | 2405639 | * | 9/2005 |

OTHER PUBLICATIONS

Batton et al.,"A New Green Corrosion Inhibitor for Boiler Condensate", Corrosion, 1999.

Kathin et al.,"Improved Boiler Feed Water Treatment Programme",18th World Petroleum Congress, Sep. 25-29, 2005, Location: Johannesburg, South Africa.

Zhang et al.,"Polyamine compound as a volatile corrosion inhibitor for atmospheric corrosion of mild steel", Materials and Corrosion,vol. 58, Issue 8, pp. 594-598, 2007.

Crovetto et al.,"Research Evaluation of Polyamine Chemistry for Boiler Treatment: Corrosion Protection", Corrosion 2011.

Cyrus B Meher-Homji et al: "Gas turbine axial compressor fouling and washing", Proceedings of the Thirty-Third Turbomachinery Symposium, 2004, XP055122299.

International Search Report issued in connection with corresponding application PCT/US2014/019521 dated Jun. 23, 2014.

* cited by examiner

Probe 1 Probe 2

Probe 1 Probe 2

"A" group foil

Control 1A pre-test: alcohol cleaned, 22ppm PA 1B pre-test: citric cleaned, 22ppm PA 1A post-test: M0.5@45°, side 1

1B post-test: M0.5@45°, side 1

1A post-test: M0.5@45°, side 2

1B post-test: M0.5@45°, side 2

COMPOSITIONS AND METHODS FOR INHIBITING CORROSION IN GAS TURBINE AIR COMPRESSORS

CROSS REFERENCE TO RELATED APPLICATION

This application claims the priority benefit of U.S. Provisional Patent Application Ser. No. 61/771,416 filed Mar. 1, 2013 and is incorporated herein.

FIELD OF THE INVENTION

The invention relates to compositions and methods for inhibiting corrosion in gas turbine air compressors resulting from surrounding environmental and process conditions.

BACKGROUND OF THE INVENTION

Electrical power plants may operate their gas turbines continuously, except for unexpected outages or maintenance, or on a non-continuous or dispatch basis, driven by cyclic electrical demand patterns. The latter plants often have idle turbines that are used only during "peak" hours when consumer demand for electricity is high. The duration of peak hours may vary depending on many factors, including the time of year, which may impact air conditioning loads, and time of day, which may impact household appliance use. Gas turbine compressors intake large volumes of air that may contain salts and other contaminants that deposit on metal surfaces and later form aqueous corrosive species when exposed to condensation during off-line periods. When not in use, turbines located outdoors are exposed to multiple environmental factors that contribute to corrosion, such as rain, thermally-driven condensation and evaporation cycles, exposure to atmospheric oxygen, and even salt water entrained in the air at power plants located near coastlines. Even if located indoors, atmospheric moisture may condense on turbine surfaces and cause corrosion.

In the aqueous electrochemical corrosion of a metal surface, an oxidation process occurs together with a reduction process. For corrosion to occur, there must be a formation of ions and release of electrons at an anodic surface where oxidation or deterioration of the metal occurs. There is a simultaneous counter-reaction at the cathodic surface to consume the electrons generated at the anode. The anodic and cathodic reactions proceed at the same time and at equivalent rates. Corrosive attack on iron is an electrochemical reaction supported by an aqueous film or electrolyte layer on the metal surface that acts like an electrochemical circuit (e.g. similar to a car battery) in accordance with Equations (I) and (II):

$$\text{At the anode (oxidation): } Fe(s) \rightarrow Fe^{2+} + 2e^- \quad \text{(I)}$$

$$\text{At the cathode (reduction): } 2H^+ + 2e^- \rightarrow H_2(g) \quad \text{(II)}$$

This reduction of hydrogen ions at a cathodic surface disturbs the balance between the acidic hydrogen ($H^+$) ions and the alkaline hydroxyl ($OH^-$) ions and makes the solution less acidic, or more alkaline, at the corroding interface. This affects the mechanism of oxygen reduction as in Equations (III) and (IV):

$$\text{(acid solutions): } O_2 + 4H^+ + 4e^- \rightarrow 2H_2O \quad \text{(III)}$$

$$\text{(neutral or basic solutions) } O_2 + 2H_2O + 4e^- \rightarrow 4OH^- \quad \text{(IV)}$$

Iron oxidizes and corrodes much more readily when dissolved oxygen is present in the aqueous film. The aqueous film may be present from a variety of sources, including, but not limited to, water washing, atmospheric condensation, rainwater, and seawater mist in coastal areas. When dissolved oxygen is present, both generalized corrosion and oxygen pitting may occur. Generalized corrosion results in a loss of metal from the entire surface. Oxygen pitting results in a highly localized loss of surface metal that may result in a large defect or stress concentration on the metal surface, leading to cracking and component failure. It is well known that certain negatively charged ions (termed anions), such as chloride ($Cl^-$) and sulfate ($SO_4^{2-}$), can accelerate corrosion reactions by migrating to the anodic sites and facilitating the neutralization and solvation of the new formed ferrous ions ($Fe^{2+}$), which as shown above, are the first products of the iron corrosion, or oxidation, reaction at the anode. This effect is often termed "depolarization". These anions can facilitate or accelerate both localized corrosion reactions, often termed "pitting attack", as well as general corrosion over a wider area of the affected metal surface.

BRIEF DESCRIPTION OF THE INVENTION

It was surprisingly discovered that corrosion inhibiting compositions comprising filming amines are effective at inhibiting corrosion on metal surfaces even under conditions typical to gas turbine air compressors. Accordingly, methods and compositions are disclosed for inhibiting corrosion on metal surfaces of gas turbine air compressors. The methods comprise contacting the metal surfaces with a corrosion inhibiting composition comprising at least one filming amine.

In one embodiment, the filming amine may have the general formula Y—R wherein Y is a heteroatom (N or O) containing group, or multiple heteroatom containing group, and wherein R is an alkyl chain derived from a fatty acid. In another embodiment, the filming amine may be selected from the group consisting of N-oleylamine, N-octadecylamine, (Z)—N-9-octadecenyl-1,3-propanediamine, octadecenylaminotrimethylene amine, octadecenylaminodi-(trimethylamino)-trimethylene amine, N-stearyl-1,3-propanediamine, N-(2-aminopropyl)-N-hexadecyl-N-methyl-1,3-propanediamine, and mixtures thereof.

In another embodiment, the composition may further comprise at least one neutralizing amine. The neutralizing amine may be selected from the group consisting of ammonia, hydrazine, methylamine, dimethylamine, trimethylamine, cyclohexylamine, ethanolamine ("MEA"), morpholine, N,N-dimethylaminopropylamine ("DMAPA"), methoxypropylamine, N,N-diethylaminoethanol ("DEAE"), N,N-dimethylethanolamine ("DMAE"), and mixtures thereof.

In another method, the weight ratio of the filming amines to the neutralizing amines may range from about 1:0 to about 1:25. In yet another method, the weight ratio may range from about 1:2 to about 1:10. Alternatively, the weight ratio of filming amines to neutralizing amines may be about 1:4.

In another method, the composition may comprise at least two neutralizing amines. The composition may be diluted with water or an aqueous solution. The concentration of the composition may range from about 0.1 to about 20,000 ppm by volume of water.

In another embodiment, the method may further comprise contacting the metal surfaces with a citric acid solution before contacting the metal surfaces with the corrosion inhibiting composition. In yet another embodiment, the method may further comprise rinsing the metal surfaces with water after contacting the surfaces with the citric acid solution and before contacting the metal surfaces with the composition. In yet another embodiment, the metal surfaces are surfaces of gas turbine air compressors.

In another embodiment, a method of washing an offline gas turbine air compressor is disclosed. The offline wash method may comprise a wash cycle, a rinse cycle, and an offline treatment cycle. The offline treatment cycle may comprise contacting metal surfaces of the gas turbine air compressor with a corrosion inhibiting composition comprising at least one filming amine. Suitable filming amines include those described above. In yet another embodiment, a method of washing an online gas turbine air compressor is disclosed. The online wash method may comprise an online treatment cycle comprising contacting the metal surfaces of the gas turbine air compressor with a corrosion inhibiting composition comprising at least one filming amine. Suitable filming amines include those described above. In another online wash method, the method may comprise a rinse cycle before the online treatment cycle.

DETAILED DESCRIPTION OF EXEMPLARY EMBODIMENTS

Figure 1:
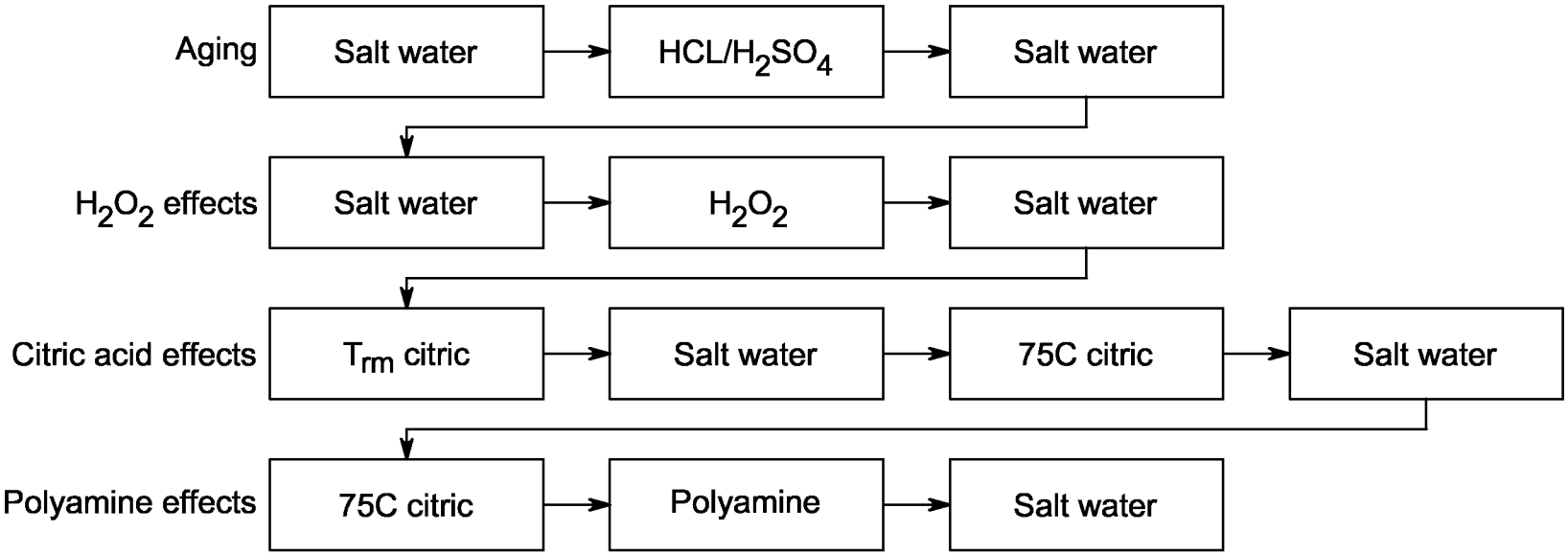
FIG. 1 is a flowchart showing the sequence of solutions to which electrical probes were exposed in corrosion simulations.

Corrosion inhibiting compositions comprising one or more filming amines, and frequently neutralizing amines, have been used in boiler applications. While such compositions have been used in boiler applications, it was not previously known that such compositions would effectively inhibit corrosion in the environmental and processing conditions typically surrounding gas turbine air compressors.

The operating conditions in boiler applications are very different from the conditions surrounding gas turbine air compressors. Firstly, boiler feedwater undergoes extensive purification steps before it is used in the boiler. As a result, boiler feedwater typically has very low levels of corrosion inducing contaminants, such as inorganic salts, acids, bases, and gases. Typically, boilers operate at high temperatures and pressures with very low levels of oxygen in a two-phase steam and water environment. Dissolved oxygen has extremely low solubility in water at the temperatures at which boiler systems operate, typically significantly above the boiling point of water at atmospheric pressure (<212° F. or 100° C.). Boilers are normally equipped with mechanical or thermal deaerating equipment (commonly referred to as "deaerators") for the express purpose of heating and removing dissolved oxygen from the boiler feedwater. Deaerators can typically produce heated boiler feedwater containing dissolved oxygen levels below 10 parts-per-billion as $O_2$ (ppb by weight or ugl). After deaerating, it is common practice to add chemical dissolved oxygen scavengers to remove any final traces of dissolved oxygen from boiler feedwater. In addition, corrosion inhibitors may be added to process water continuously while the boiler is in operation.

In contrast, gas turbine air compressors are typically washed with fully aerated water at atmospheric temperatures and pressures. Under these conditions, the water normally contains between 7 and 10 parts-per-million (ppm by weight) of dissolved oxygen as $O_2$, or 7,000 to 10,000 ppb $O_2$. Gas turbine air compressors may also be exposed to natural waters, such as rainwater or liquid water formed by atmospheric condensation. Natural waters typically contain between several hundred to several thousand times higher levels of dissolved oxygen than boiler water or condensed steam.

Further, gas turbine air compressors intake air at ambient conditions where oxygen concentrations are relatively high. At ambient conditions, the air compressors are exposed to the common, prevailing, and uncontrolled atmospheric and weather conditions of their geographic location, including temperatures, pressures, and moisture. As mentioned earlier in this specification, the presence of high levels of dissolved oxygen in water films contacting metal surfaces significantly increases both the corrosion rates and the types of corrosion that occurs. While corrosion inhibitors may be added to turbine online wash water, there is a need for methods of inhibiting corrosion on idle gas turbine surfaces as well.

Gas turbine air compressors may also experience a wide variety of temperatures, depending on geographic location and time of year. These temperatures may range from about −18° C. to about 50° C. (0° F.-120° F.). When in operation, the temperatures within the air compressors may reach as high as 750-950° F. (400-480° C.

Previous tests using filming amines under simulated boiler water conditions showed that the filming amines were unlikely to work well in applications using water containing dissolved oxygen levels above 1,000 parts-per-billion as $O_2$ (ppb by weight or μgl). It was surprisingly discovered, however, that corrosion inhibiting compositions comprising filming amines are effective at inhibiting corrosion on metal surfaces of gas turbine air compressors even under exposure conditions typical to gas turbine air compressors. Accordingly, methods and compositions are disclosed for inhibiting corrosion on metal surfaces. The methods comprise contacting the metal surfaces with a corrosion inhibiting composition comprising at least one filming amine.

The corrosion inhibiting composition may be applied when washing the gas turbine air compressor. Typically, operators may utilize two types of compressor washing, online and offline washing. In offline washing, the unit is not generating power and is typically turned at about 800 RPM (rotations per minute) by a "turning gear" motor. Offline washes are utilized during routine cleaning or before the gas turbine air compressor is rendered idle. Typical offline washes include at least a wash, rinse, and a dry cycle. The wash cycle includes the use of a cleaning agent, such as a surfactant or detergent to wash dirt and debris from the compressor. Corrosion inhibitors, if used, are applied during the wash cycle. After the wash cycle, a rinse is applied to the compressor to remove any remaining surfactant. The dry cycle may comprise an unfired spin on the motor starter to remove excess fluid by centrifugal force. When applied as part of an offline wash, the corrosion inhibitors may last 72 hours to about 3 weeks if the compressor is rendered idle after the offline wash.

Online washes occur when the gas turbine air compressor is generating power or operating at full speed or load. Online washes are typically used when the compressor is clean or fairly clean and the operator does not want to bring the compressor offline. Normally, only deionized (DI) water is used for online washing. Detergents or surfactants are not used as they may build up on the hot running unit. Moreover, some surfactants may actually increase corrosion as they act as a strong electrolyte and may wet compressor surfaces.

The corrosion inhibiting composition of the present invention may be used in both offline and online washes. If used in an offline wash, the corrosion inhibiting composition may be applied after the wash and rinse cycles as a separate treatment cycle to ensure the composition is applied to as clean a surface as possible and hence maximize the efficacy of the film forming mechanism. Unlike prior art corrosion inhibitors, the compositions of the present invention may also be used in online washes to extend the corrosion inhibiting period of clean or relatively clean compressors.

In addition the uses described above, the compositions may also be added to the low-pressure steam injected into the gas turbine air compressor, added to the air compressor post-rinse water, or added separately from the wash water as a spray or aerosol. The corrosion inhibiting composition may also be applied using other methods anticipated by those of ordinary skill in the art whereby the metal surfaces are contacted with the corrosion inhibiting composition. Such anticipated methods are intended to be within the scope of this invention.

A filming amine as used herein may be any material that forms an organic film on metal surfaces thereby preventing corrosive and oxidizing materials from contacting the metal surfaces. Examples of corrosive and oxidizing materials include, but are not limited to, oxygen, dissolved oxygen, chloride and sulfide salts, and acidic species, such as carbonic acid. Suitable filming amines have the general formula Y—R wherein Y is a heteroatom (N or O) containing group, or multiple heteroatom containing group, and wherein R is an alkyl chain derived from a fatty acid. These filming amines include ethoxylated fatty amines and diamines, octadecylamine, ethoxylated tallow amines, and ethoxylated oleic acids. Suitable ethoxylated fatty amines include those with saturated $C_{12}$-$C_{18}$ chains, such as bis(2-hydroxyehtyl) cocoamine. In one embodiment, R may be an oleyl radical and Y may be $NHCH_2CH_2CH_2NH_2$. Accordingly, suitable filming amines may include bis(2-hydroxyethyl) cocoamine and/or at least one fatty polyamine of the formula:

$$H_2N-\left((CH_2)_x-NH\right)_y-R_1$$

wherein x may range from about 1 to about 8; y may range from about 0 to about 7; and $R_1$ may be a saturated or unsaturated aliphatic $C_{12}$-$C_{24}$ hydrocarbon radical. In another embodiment, $R_1$ may be a saturated or unsaturated aliphatic $C_{12}$-$C_{18}$ hydrocarbon radical. Specific examples of a filming amine include, but are not limited to, N-oleylamine, N-octadecylamine, (Z)—N-9-octadecenyl-1,3-propanediamine, octadecenylaminotrimethylene amine, octadecenylaminodi-(trimethylamino)-trimethylene amine, N-stearyl-1,3-propanediamine, N-(2-aminopropyl)-N-hexadecyl-N-methyl-1,3-propanediamine, and mixtures thereof.

In another embodiment, the composition may further comprise at least one neutralizing amine. A neutralizing amine as used herein may be one or more materials that neutralize carbonic acid and raise the pH of water. These materials include ammonia, hydrazine, alkylamines, cyclic amines (arylamines), alkanolamines, and mixtures thereof. Specific examples of a neutralizing amine include, but are not limited to, methylamine, dimethylamine, trimethylamine, cyclohexylamine, ethanolamine (monoethanolamine or "MEA"), morpholine, N,N-dimethylaminopropylamine ("DMAPA"), methoxypropylamine, N,N-diethylaminoethanol ("DEAE"), and N,N-dimethylethanolamine ("DMAE").

In another method, the weight ratio of the filming amines to the neutralizing amines may range from about 1:0.1 to about 1:25. In yet another method, the weight ratio may range from about 1:2 to about 1:10. Alternatively, the weight ratio of filming amines to neutralizing amines may be about 1:4.

In another method, the composition may comprise at least two neutralizing amines. The composition may be diluted. Suitable dilutants include, but are not limited to water, low molecular weight alcohols, and the neutralizing amine cyclohexylamine. In another embodiment, the composition may be diluted with water or an aqueous solution. The concentration of the composition may range from about 0.1 to about 20,000 ppm by volume of water.

Exemplary corrosion inhibiting compositions may have any formulation falling within the ranges listed in Table 1 below, with the proviso that the weight ranges of the individual components are chosen such that the total weight percent of the corrosion inhibiting composition is equal to 100 wt %.

TABLE 1

Polyamine blend - Corrosion Inhibiting Composition

| Component type | Polyamine blend | Range (wt %) |
|---|---|---|
| dilutant/neutralizing amine | cyclohexylamine | 0-40 |
| neutralizing amine | morpholine | 0-15 |
| neutralizing amine | monoethanolamine | 7-30 |
| neutralizing amine | N,N-dimethylaminopropylamine | 0-50 |

TABLE 1-continued

| Polyamine blend - Corrosion Inhibiting Composition | | |
|---|---|---|
| Component type | Polyamine blend | Range (wt %) |
| neutralizing amine | N,N-diethylaminoethanol | 0-15 |
| filming amine | (Z)-N-9-octadecenyl-1,3-propanediamine | 5-20 |
| filming amine | (Z)-9-octadecene-1-amine | 1-5 |
| dilutant | demineralized or deionized water | Balance (0-65) |

Persons of ordinary skill in the art will understand that more than one formulation may fall within the ranges listed in Table 1. Accordingly, in another embodiment, the corrosion inhibiting composition may have a formulation as listed under Formula 1, Formula 2, Formula 3, Formula 4, or Formula 5 listed in Table 2.

TABLE 2

| Polyamine blend | Formula 1 (wt %) | Formula 2 (wt %) | Formula 3 (wt %) | Formula 4 (wt %) | Formula 5 (wt %) |
|---|---|---|---|---|---|
| cyclohexylamine | 15 | 40 | 0 | 20 | 0 |
| morpholine | 7 | 13 | 0 | 10 | 0 |
| monoethanolamine | 7 | 13 | 25 | 10 | 26 |
| N,N-dimethylamino propylamine | 0 | 0 | 35 | 0 | 43 |
| N,N-diethylaminoethanol | 0 | 0 | 15 | 0 | 12 |
| (Z)-N-9-octadecenyl-1,3-propanediamine | 7 | 13 | 20 | 8.5 | 16.2 |
| (Z)-9-octadecene-1-amine | 1 | 5 | 5 | 1.5 | 2.8 |
| demineralized or deionized water | 63 | 16 | 0 | 50 | 0 |

In another embodiment, the method may further comprise contacting the metal surfaces with a citric acid solution before contacting the metal surfaces with the corrosion inhibiting composition. Without limiting the invention to one theory of operation, it is thought the citric acid wash provides a clean surface that may aid the film forming amine to adhere better to the metal surface and improve the film-forming mechanism. The citric acid wash is not necessary if the steel surface is already clean and free of residual soap, dirt, or corrosion product on the blade. Electrochemical impedance spectroscopy testing showed that on clean metal surfaces, pretreatment with dilute citric acid prior to application of filming amine did not provide additional passivation benefits. However, it is expected that on a fouled and or corroded metal surface, the citric acid will provide additional cleaning and iron oxide chelating benefits which will improve amine filming action efficacy. In yet another embodiment, the method may further comprise rinsing the metal surfaces with water after contacting the surfaces with the citric acid solution and before contacting the metal surfaces with the composition.

The metal surfaces may be exposed to additional water or moisture with a high oxygen content during or after treatment with the corrosion inhibiting composition. Accordingly, in yet another method, the metal surfaces may be exposed to additional moisture and/or water and/or an aqueous solution during and/or after treatment. The additional moisture and/or water and/or an aqueous solution may have greater than 100 parts-per-billion (ppb by weight) of dissolved oxygen (02) therein. In one embodiment, the dissolved oxygen content may range from about 1,000 ppb (0.1 ppm) to about 10,000 ppb (10,000 ppm) by weight. Alternatively, the dissolved oxygen content may range from about 7,000 to about 10,000 ppb by weight.

As mentioned above, gas compressors operate at ambient temperatures and pressures where oxygen concentrations are relatively high. The presence of oxygen increases corrosion rates and the types of corrosion that occurs. While corrosion inhibitors may be added to turbine online wash water, tests have shown that these inhibitors lose their effectiveness after the turbine is back online. Thus, there is a need for methods of inhibiting corrosion on both idle and operating gas turbine surfaces. The corrosion inhibiting composition disclosed herein is suitable for inhibiting corrosion on idle gas turbine surfaces. The corrosion inhibiting composition may also be used to inhibit corrosion while the turbine is online.

Accordingly, in another embodiment, a method of washing an offline gas turbine air compressor is disclosed. The offline wash method may comprise a wash cycle, a rinse cycle, and an offline treatment cycle. The offline treatment cycle may comprise contacting metal surfaces of the gas turbine air compressor with a corrosion inhibiting composition comprising at least one filming amine. Suitable filming amines include those described above, including filming amines with the general formula Y—R wherein Y is a hetero atom (N or O) containing group, or a multiple heteroatom containing group, and wherein R is an alkyl chain derived from a fatty acid. In one embodiment, R may be an oleyl radical and Y may be $NHCH_2CH_2CH_2NH_2$. These filming amines include ethoxylated fatty amines and diamines, octadecylamine, ethoxylated tallow amines, and ethoxylated oleic acids. Suitable ethoxylated fatty amines include those with saturated $C_{12}$-$C_{18}$ chains, such as bis(2-hydroxyehtyl) cocoamine. Accordingly, suitable filming amines may include bis(2-hydroxyethyl) cocoamine and/or at least one fatty polyamine of the formula:

$$H_2N-(CH_2)_x-NH)_y-R_1$$

wherein x may range from about 1 to about 8; y may range from about 0 to about 7; and $R_1$ may be a saturated or unsaturated aliphatic $C_{12}$-$C_{24}$ hydrocarbon radical. In another embodiment, $R_1$ may be a saturated or unsaturated aliphatic $C_{12}$-$C_{18}$ hydrocarbon radical. Specific examples of a filming amine include, but are not limited to, N-oleylamine, N-octadecylamine, (Z)—N-9-octadecenyl-1,3-propanediamine, octadecenylaminotrimethylene amine, octadecenylaminodi-(trimethylamino)-trimethylene amine, N-stearyl-1,3-propanediamine, N-(2-aminopropyl)-N-hexadecyl-N-methyl-1,3-propanediamine, and mixtures thereof.

In another embodiment, the composition may further comprise at least one neutralizing amine. Suitable neutralizing amines include, but are not limited to ammonia, hydrazine, alkylamines, cyclic amines (arylamines), alkanolamines, and mixtures thereof. Specific examples of a neutralizing amine include, but are not limited to, methylamine, dimethylamine, trimethylamine, cyclohexylamine, ethanolamine ("MEA"), morpholine, N,N-dimethylaminopropylamine ("DMAPA"), methoxypropylamine, N,N-diethylaminoethanol ("DEAE"), and N,N-dimethylethanolamine ("DMAE").

In another method, the weight ratio of the filming amines to the neutralizing amines may range from about 1:0.1 to about 1:25. In yet another method, the weight ratio may range from about 1:2 to about 1:10. Alternatively, the weight ratio of filming amines to neutralizing amines may be about 1:4.

In another method, the composition may comprise at least two neutralizing amines. The composition may be diluted. Suitable dilutants include, but are not limited to water, low molecular weight alcohols, and cyclohexylamine. In another embodiment, the composition may be diluted with water or an aqueous solution. The concentration of the composition may range from about 0.1 to about 20,000 ppm by volume of water In yet another embodiment, a method of washing an online gas turbine air compressor is disclosed. The online wash method may comprise an online treatment cycle comprising contacting the metal surfaces of the gas turbine air compressor with a corrosion inhibiting composition comprising at least one filming amine. Suitable filming amines include those described above. In another online wash method, the method may comprise a rinse cycle before the online treatment cycle.

EXAMPLES

Gas Turbine Applications

The corrosion effects on gas turbine air compressor grade material were simulated in the laboratory using two coupled multi-electrode array ("CMA") probes, Probe 1 (P#1) and Probe 2 (P#2). The probe electrodes were made of 17-4PH stainless steel, a gas turbine air compressor grade material.

The probes were connected to a nanoCorr® field monitor equipped with a CMA sensor. The CMA sensor measures the flow of electrons from corroding electrodes to the cathodes. The corroding electrodes in the CMA probes act like the anodic sites in a corroding material. Accordingly, the flow of electrons from the corroding electrodes may be used to calculate the corrosion rate for the electrode material, in this case, 17-4PH.

The corrosion rate of 17-4PH was monitored in response to immersing the scratched probes in multiple solutions as described in the following paragraphs. The tests were performed by exposing the probes to different solutions sequentially. The solutions used are listed in Table 3.

TABLE 3

| Solution | DI Water (ml) | Tap Water (ml) | Iodized Salt (g) | $H_2O_2$ | HCl (ml) | $H_2SO_4$ (ml) | Citric Acid (g) | Formula 4 (ml) |
|---|---|---|---|---|---|---|---|---|
| Salt Water | 200 | | 10.0 | | | | | |
| Aging | 100 | 100 | | | 2 | 2.5 | | |
| $H_2O_2$ | 100 | | | 30% | | | | |
| Citric Acid | 100 | | | | | | 20 | |
| Example 1 | 250 | | | | | | | 5 |

Figure 2:
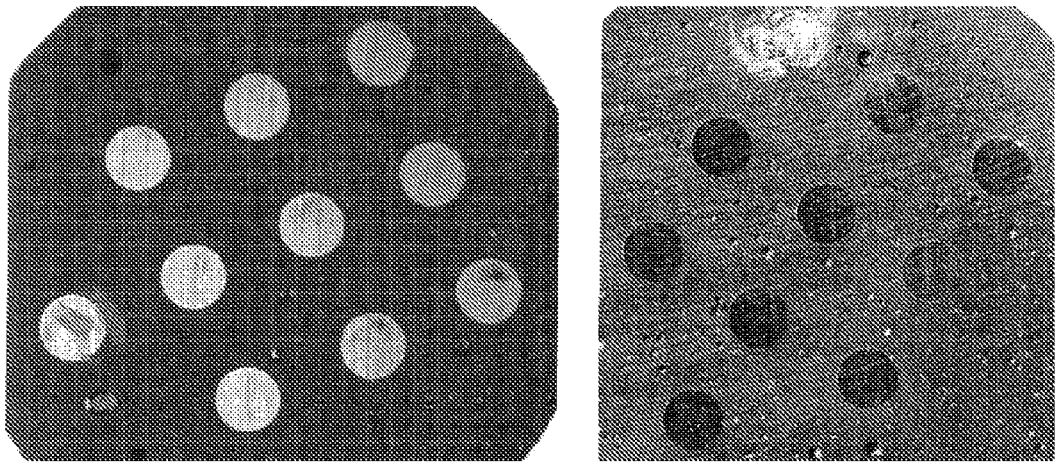
FIG. 2 shows the probes after the surfaces were scratched and before the probes were exposed to any solutions.

The probes were exposed to the solutions sequentially as shown in FIG. 1. Between each solution exposure, the probes were rinsed with deionized (DI) water and dried (not shown). The probe surface was not polished to refresh the surface between solution exposures. Prior to performing the corrosion simulating tests, one electrode from each probe was scratched to encourage corrosion pit nucleation. Pictures of the probes after scratching and before exposure to any of the solutions are shown in FIG. 2.

As shown in FIG. 1, a salt water solution was used several times throughout the tests to simulate the environmental and process conditions surrounding gas turbine air compressors. The probes were also subjected to an aging step to accelerate electrode corrosion. After the aging step, the effects of an $H_2O_2$ wash step were determined. The $H_2O_2$ solution was used to breakdown any oily deposits present on the sensor thereby improving exposure efficiencies. The probes were then subjected to an acid wash process to remove any rust present on the probes and improve filming efficiencies. The acid wash comprised a citric acid solution. Finally the effects of a polyamine blend, on the corrosion rates of the probes was measured. For Example 1, Formula 4 (see Table 2) was diluted with deionized (DI) water.

Figure 3:
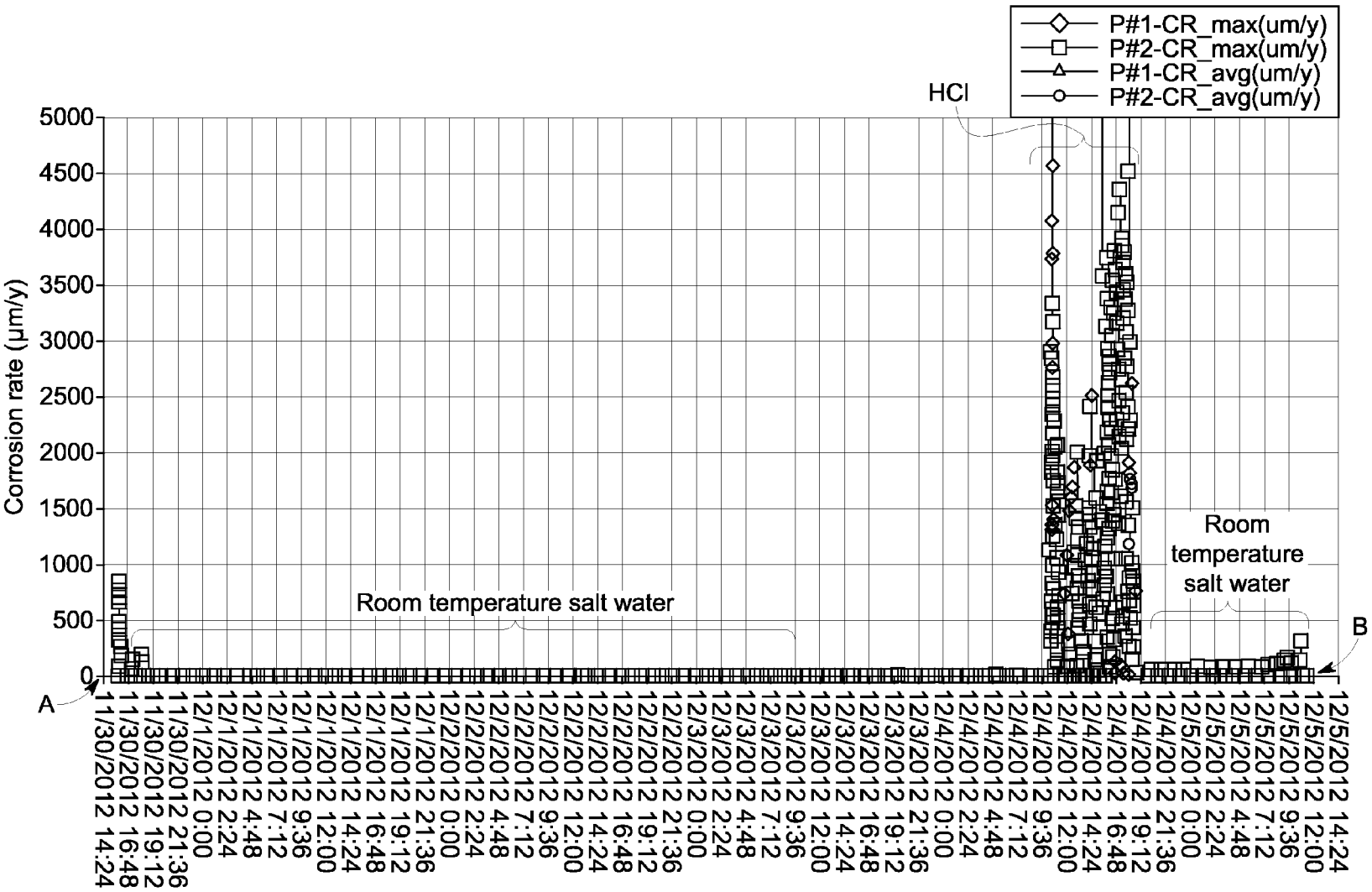
FIG. 3 shows a chart of the corrosion rates (μm/y) of the probes during the aging step.
Figure 4:
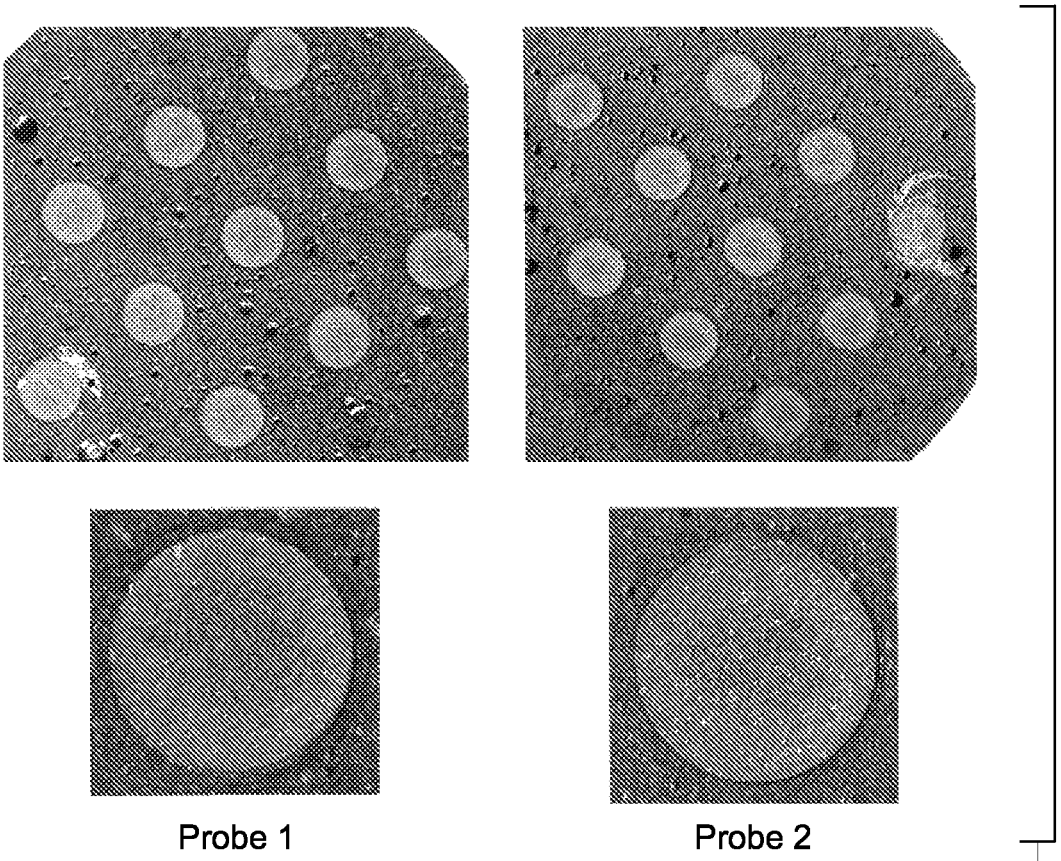
FIG. 4 shows the probes after the aging step.

FIG. 3 shows a chart of the corrosion rates (μm/y) of the probes during the aging step. The aging step comprised immersing the probes in room temperature salt water for about 4 days and then in salt water heated to 75° C. for about 24 hours. To accelerate electrode corrosion, the probes were then immersed in an aging solution comprising aqueous HCl and $H_2SO_4$ for about 10 hours. FIG. 3 shows measurable corrosion of the probes, especially when they are exposed to the HCl and $H_2SO_4$ aqueous solution. The probes were then placed back in 75° C. salt water for about 2 hours. Pictures of the probes after aging are shown in FIG. 4. As shown in FIG. 4, there is visible corrosion on the probes after the aging step. Point A in FIG. 3 designates the point in the timeline when the photographs in FIG. 2 were taken. Point B in FIG. 3 represents the point in the timeline when the photographs in FIG. 4 were taken.

Figure 5:
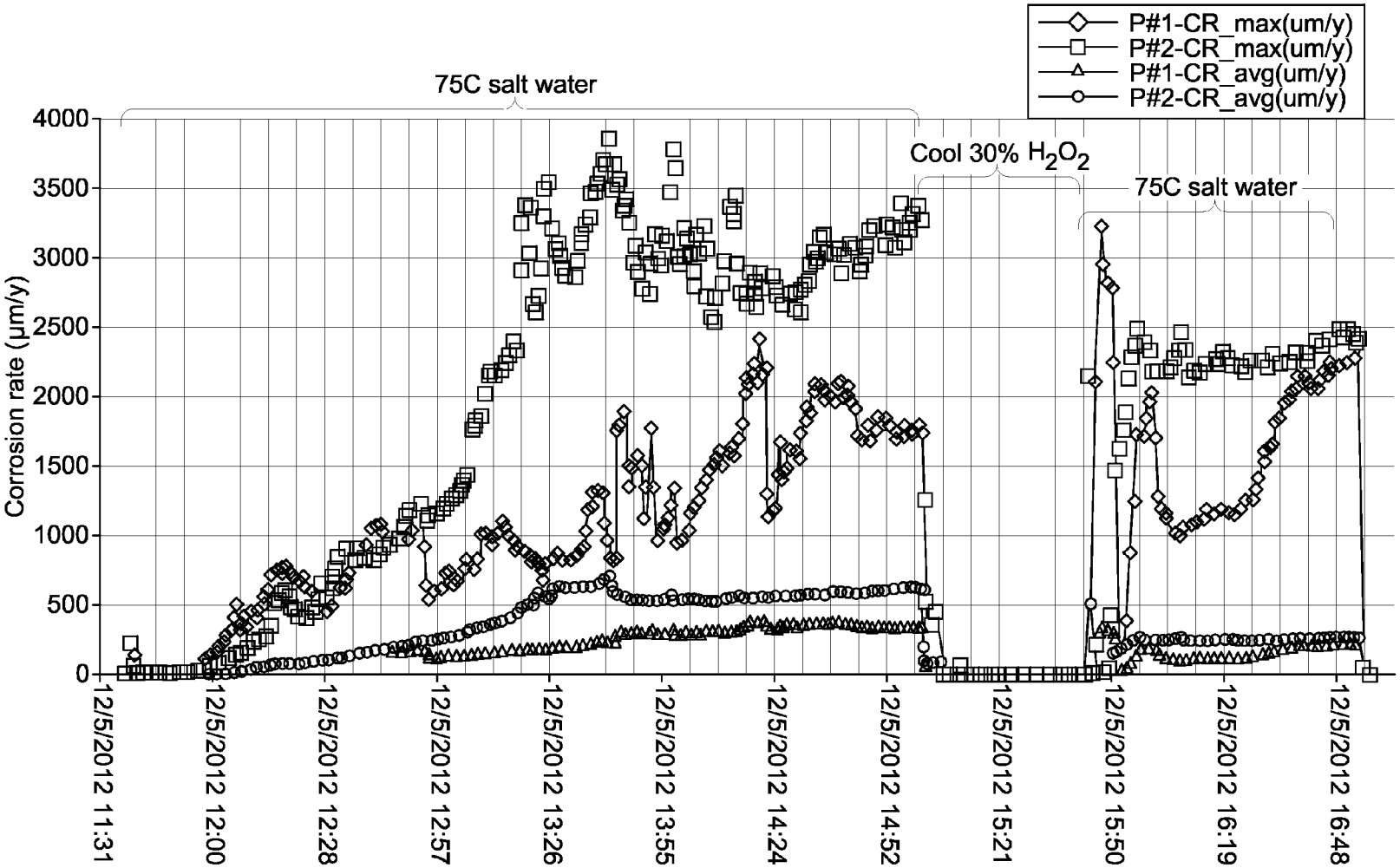
FIG. 5 shows a chart of the effects of a $H_2O_2$ wash on the corrosion rates (μm/y) of the probes.

After the aging step, the effects of washing the probes in $H_2O_2$ were observed. FIG. 5 shows the effects of the $H_2O_2$ wash on the corrosion rates (μm/y) of the probes. As shown in FIG. 5, the probes were immersed in 75° C. salt water for about 3.5 hours. Then the probes were placed in an $H_2O_2$ solution at room temperature for about 20 minutes. The probes were then placed back in 75° C. salt water for about 1 hour to compare the corrosion behavior of the probes before and after the $H_2O_2$ wash. The corrosion behavior of the probes after the $H_2O_2$ wash and during 1-hour 75° C. salt water exposure was used as the new benchmark for the citric acid wash. As may be seen in FIG. 5, there is measurable corrosion when the probes are exposed to salt water. Cleaning with $H_2O_2$ appears to reduce the amount of corrosion slightly when the probes are again exposed to salt water.

Figure 6:
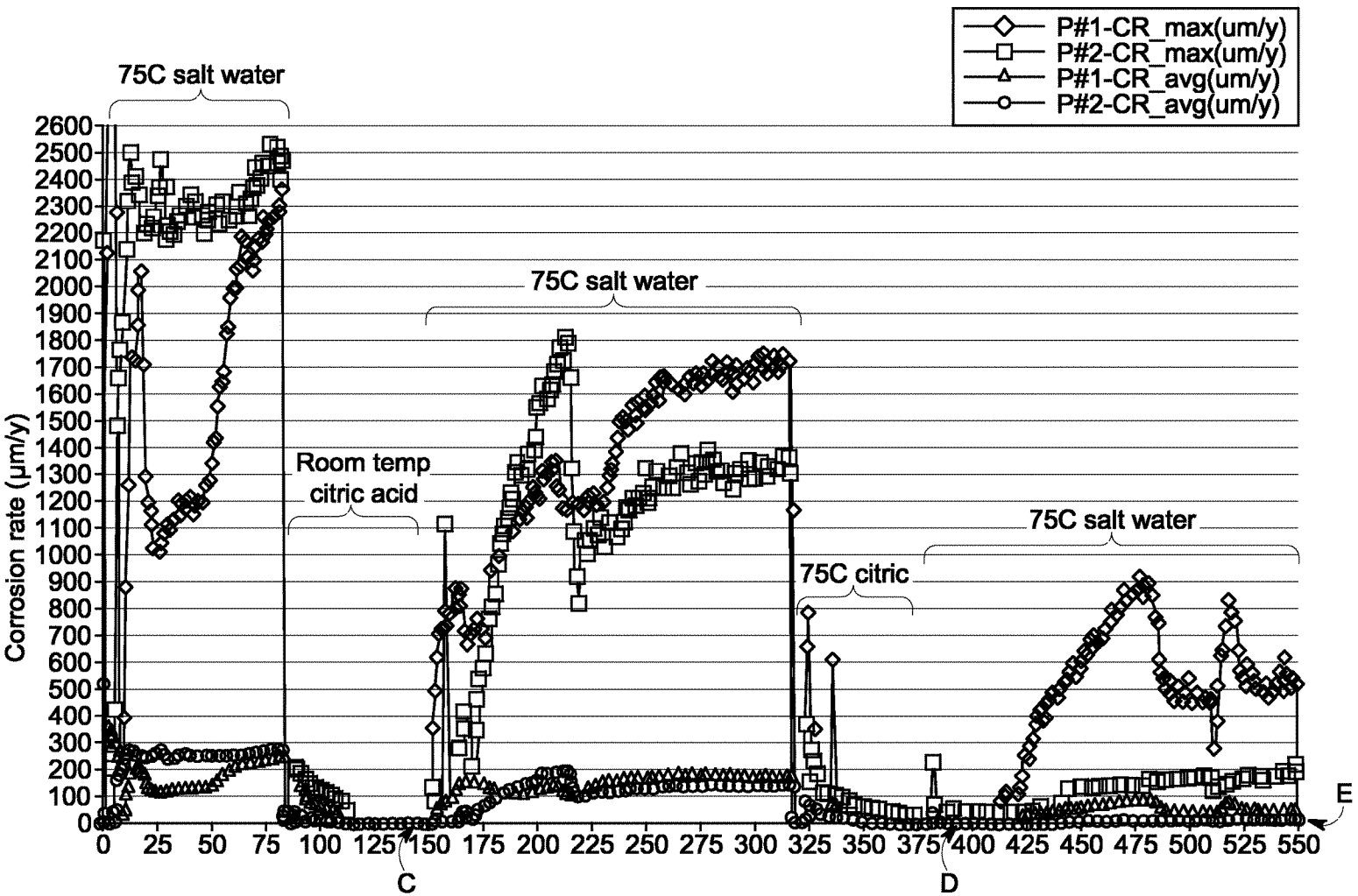
FIG. 6 shows a chart of the effects of a citric acid wash on the corrosion rates (μm/y) of the probes.
Figure 7:
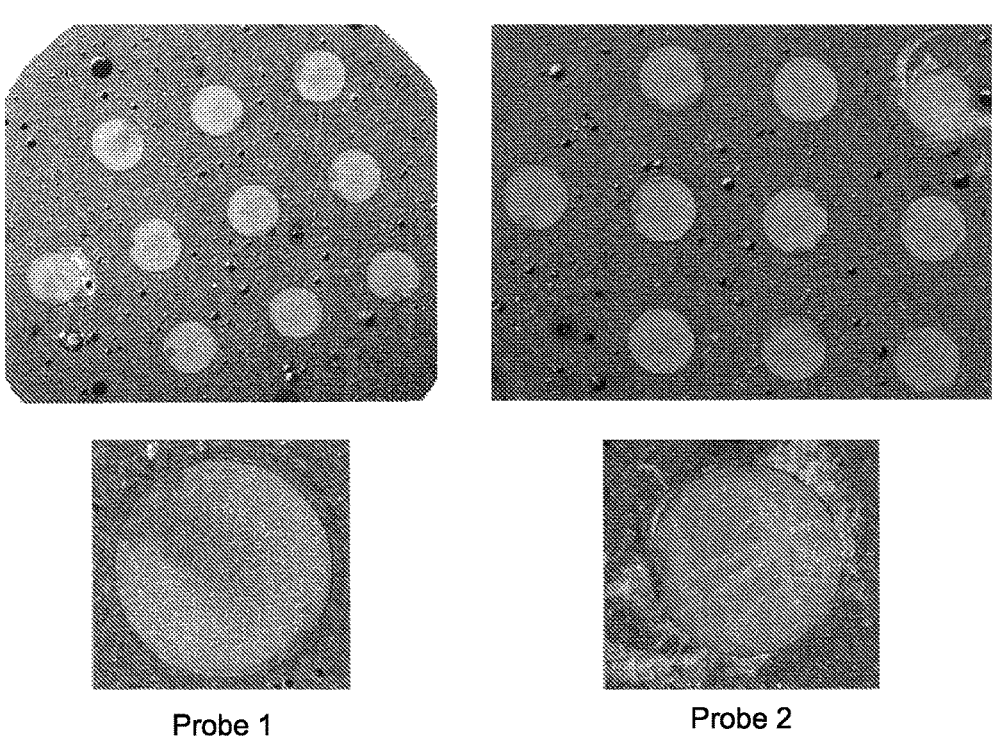
FIG. 7 shows the probes after the room temperature citric acid wash and before exposure to 75° C. salt water.
Figure 8:
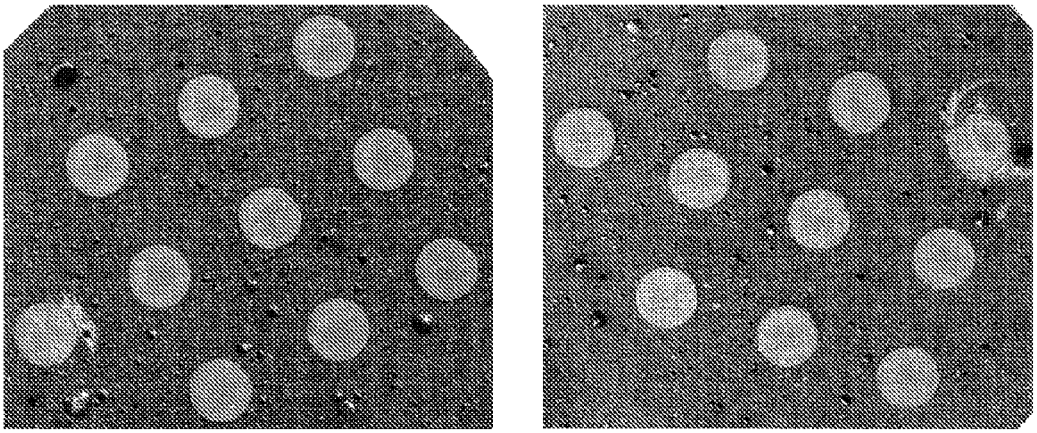
FIG. 8 shows the probes after the 75° C. citric acid wash and before exposure to 75° C. salt water.
Figure 9:
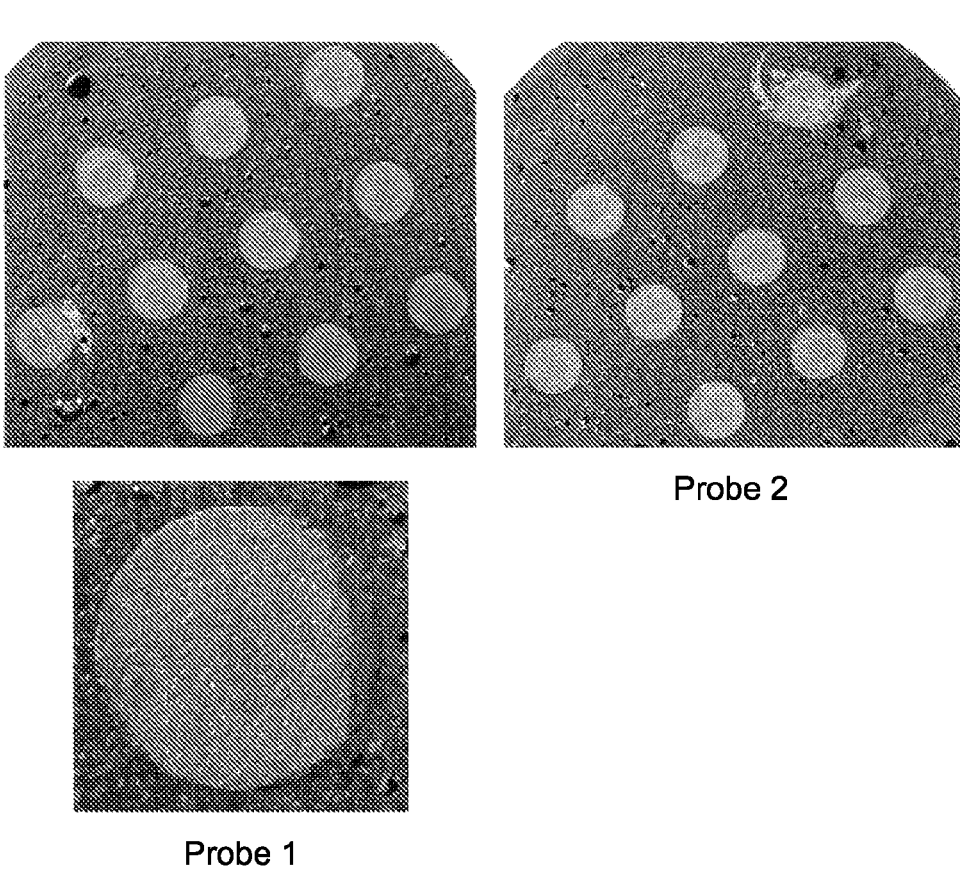
FIG. 9 shows the probes after the 75° C. citric acid wash and after exposure to 75° C. salt water.

The citric acid wash was used to provide some passivation effects and to clean any rust present on the sensor surfaces thereby improving filming efficiencies. First, the probes were immersed in a room temperature citric acid solution for about 20 minutes. Then the probes were placed in 75° C. salt water for about 3.5 hours and then transferred to a 75° C. citric acid solution for about 20 minutes. The probes were then placed back in 75° C. salt water to compare the corrosion behavior of the probes before and after the citric acid wash. The effects of the citric acid wash on the corrosion rates (μm/y) of the probes are shown in FIG. 6. The X-axis in FIG. 6 is time (minutes). FIG. 7 shows pictures of the probes after they were washed with room temperature citric acid and before they were placed back in the 75° C. salt water, represented by point C in FIG. 6. Corrosion is visible on the probes in FIG. 7. Point D in FIG. 6 is the point after the 75° C. citric acid wash before the probes were placed back in the 75° C. salt water. Pictures of the probes at point D are shown in FIG. 8. Less corrosion is visible on the probes after the 75° C. citric acid wash than after the room temperature citric acid wash. Pictures of the probes at point E, after both the 75° C. citric acid wash and exposure to 75° C. salt water, are shown in FIG. 9. Some corrosion on the probes is visible in FIG. 9. As may be seen in FIG. 6, the amount of corrosion appears reduced when the probes are washed with citric acid, especially when washed with 75° C. citric acid.

Next the effects of a polyamine blend, Example 1 ("Ex" 1), on the corrosion rates of the probes was measured. Ex 1 was a corrosion inhibiting solution comprising 5 ml of a Formula 4 in 250 ml of DI water. The polyamine blend comprised multiple neutralizing amines and a filming amine at a weight ratio of about 4:1. To measure the effect of Ex 1 on the probes, the probes were again placed in a 75° C. citric acid wash. The probes were then immersed in Ex 1 for 5 minutes. The concentration of polyamine blend to dilutant, in this case DI water, was about 20,400 ppm by volume amines to water (5 ml polyamine blend/250 ml DI water wherein the density of the polyamine blend is 1.02 g/ml). It is anticipated that lower concentrations of actives would still be effective at inhibiting corrosion in gas turbine air compressors systems. Effective concentrations may range from about 0.1 to about 2,000 ppm. In another embodiment, effective concentrations may range from about 0.1 to about 100 ppm. In yet another embodiment, effective concentrations may range from about 0.1 to about 50 ppm. Alternatively, effective concentrations may range from about 1 to about 20 ppm by volume of actives to dilutant. After the probes were submersed in Ex 1, they were submersed again in 75° C. salt water for 2 hours.

Figure 10:
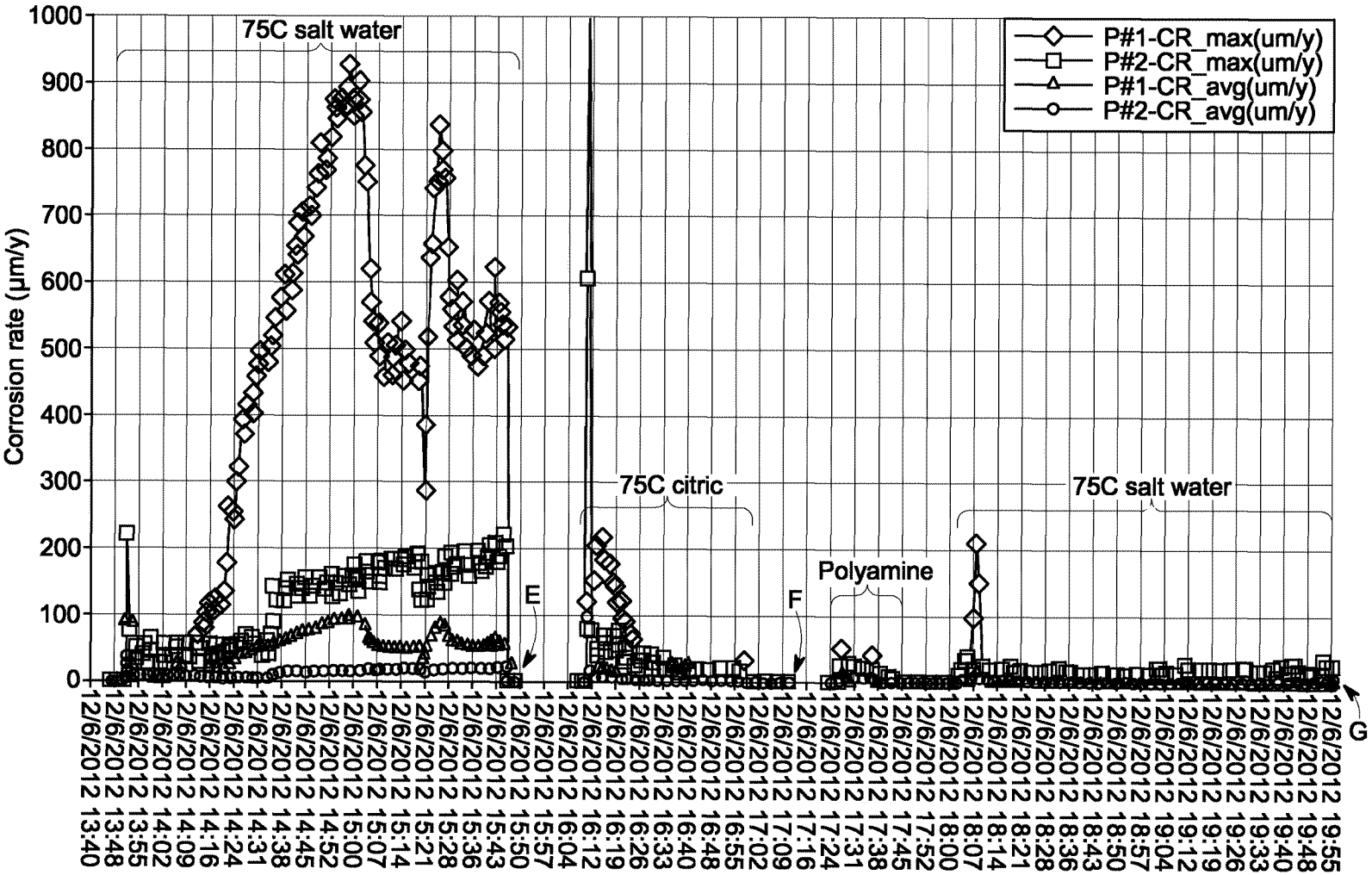
FIG. 10 shows the effect of a corrosion inhibiting composition on both the average and the maximum corrosion rates (μm/y) of the probes.
Figure 11:
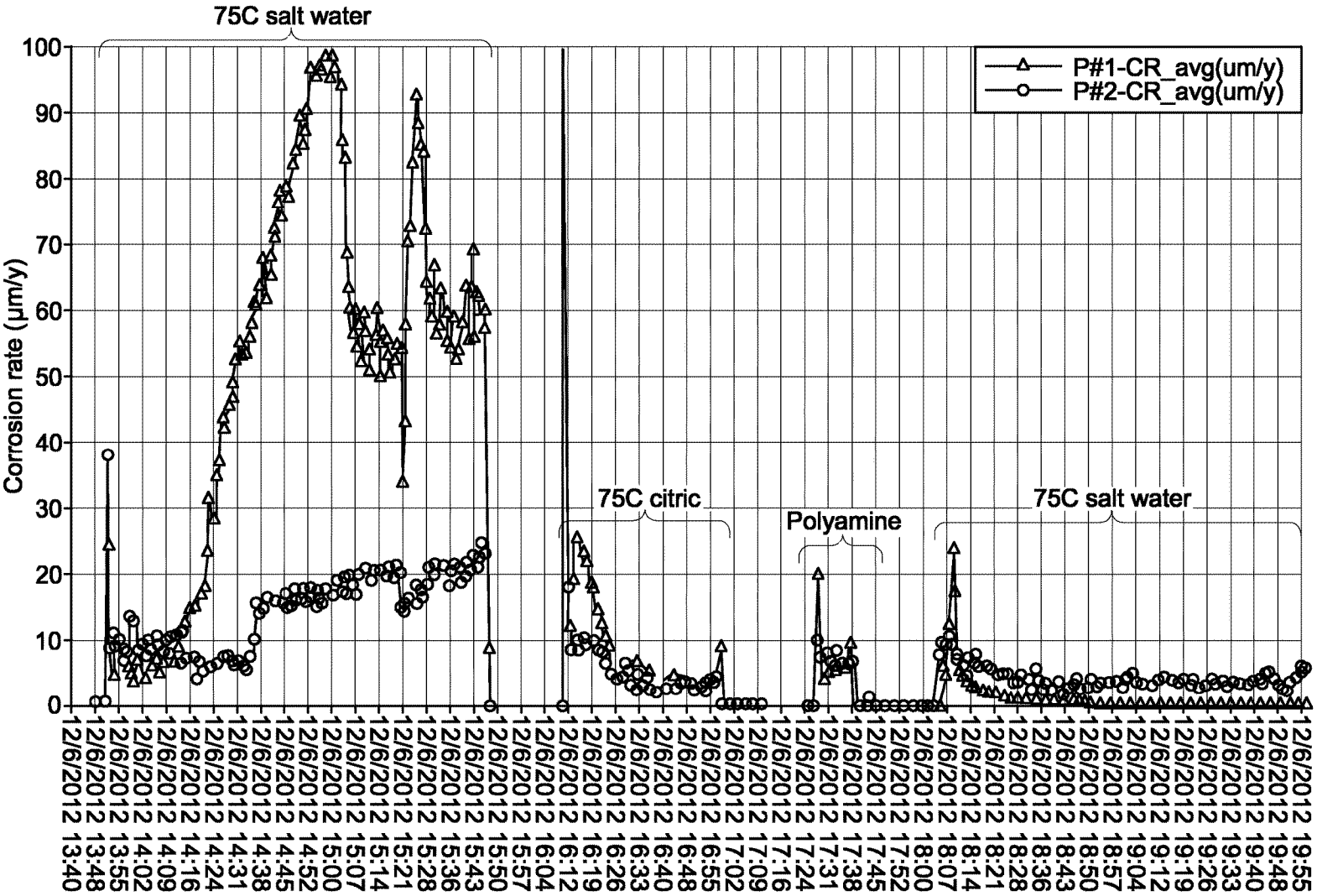
FIG. 11 shows the effect of a corrosion inhibiting composition on the average corrosion rates of the probes.
Figure 12:
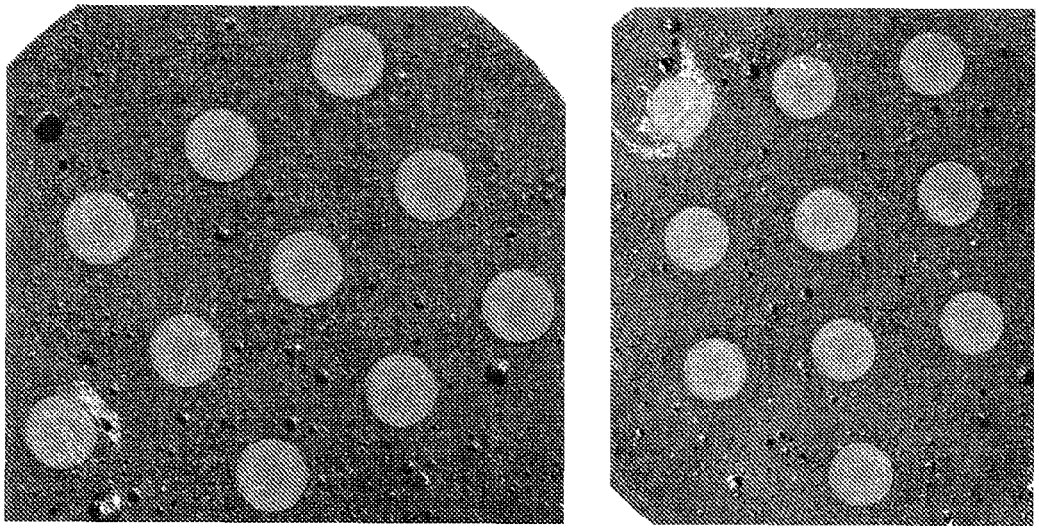
FIG. 12 shows the probes after a 75° C. citric acid wash and before exposure to a corrosion inhibiting solution.
Figure 13:
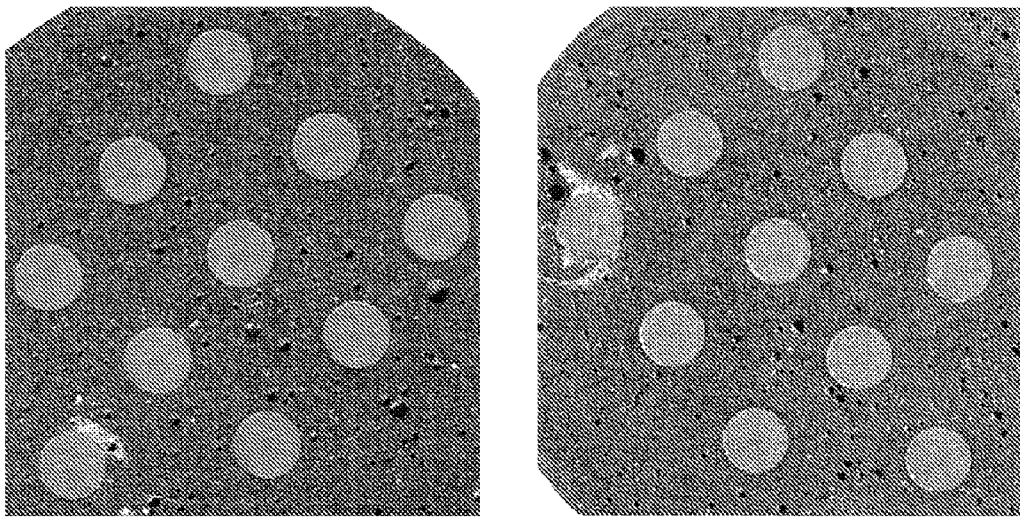
FIG. 13 shows the probes after exposure to a corrosion inhibiting solution followed by a 2-hour exposure to 75° C. salt water.

FIG. 10 shows the effect of Ex 1 on both the average and the maximum corrosion rates (μm/y) of the probes. Point E is shown again in FIG. 10. FIG. 11 shows just the effect of Ex 1 on the average corrosion rates. As may be seen in FIGS. 10 and 11, the polyamine treatment significantly reduced the amount of corrosion on the probes. FIG. 12 shows the probes at point F (FIG. 10), after the 75° C. citric acid wash and before the probes were submersed in Ex 1. FIG. 13 shows the probes after they were submersed in Ex 1 and in 75° C. salt water for 2 hours, point G in FIG. 10. Comparing FIG. 12 and FIG. 13, there is little to no corrosion visible in the probes that were exposed to salt water after the polyamine treatment.

Figure 14:
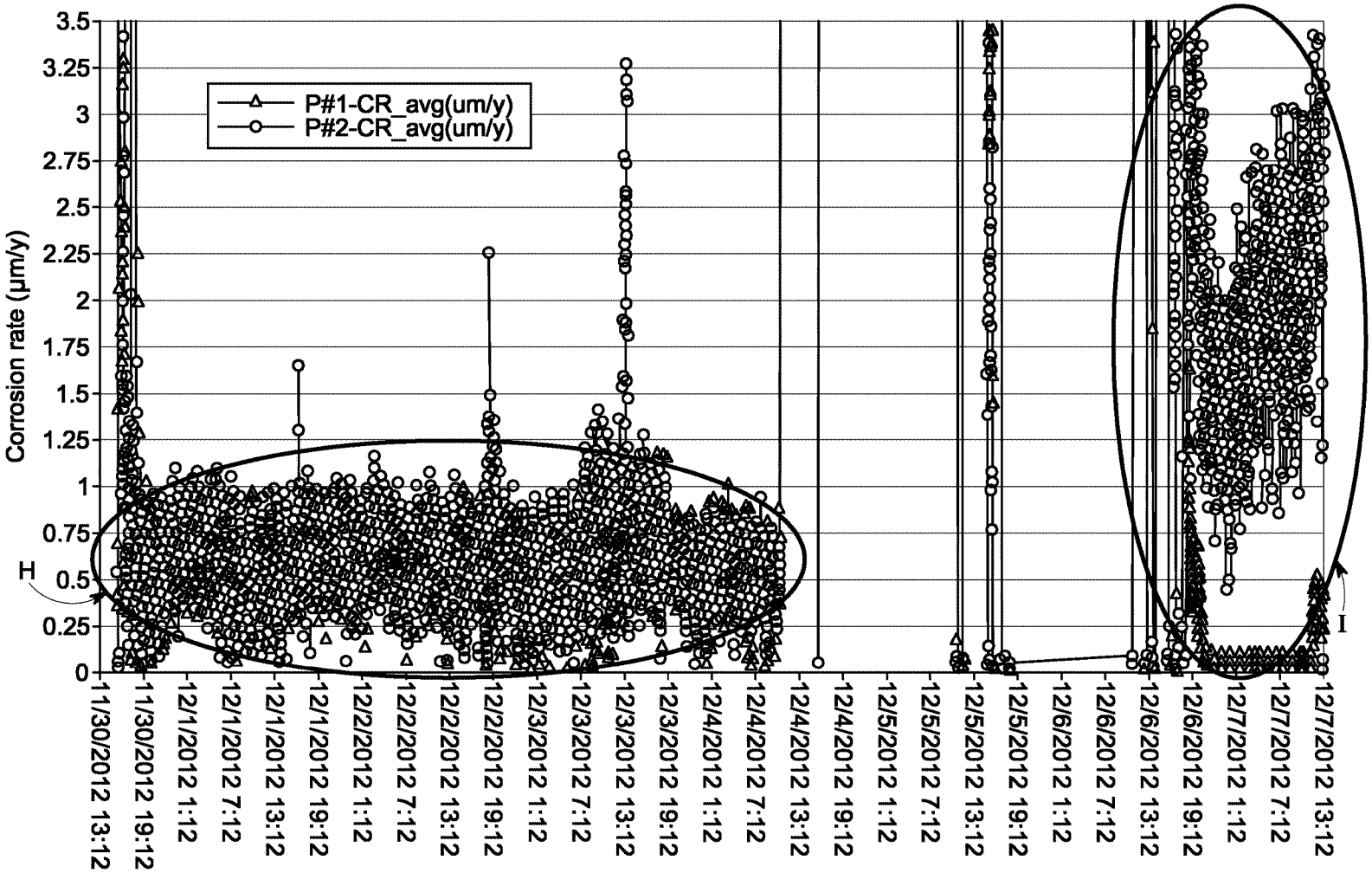
FIG. 14 shows a chart of the probes' average corrosion rates for the entire testing sequence as shown in FIG. 1.

FIG. 14 shows the average corrosion rates for the entire testing sequence as shown in FIG. 1. The ovaled areas in FIG. 14 show the average corrosion rates of the probes. Oval H encircles corrosion rates of the probes in salt water before aging. Oval I encircles corrosion rates in salt water after aging and after treating with Ex 1. AS may be seen in FIG. 14, the average corrosion rates after the polyamine treatment was less than about 3.0 μm/yr.

Polyamine Performance in High Velocity Air

The following examples demonstrate the corrosion inhibiting composition in gas turbine air compressor applications where high velocity air flow is present. The goal of the examples was to determine whether the film formed by the corrosion inhibiting composition would remain on treated metal surfaces in the operating compressor when exposed to high velocity air flow.

High velocity air tests were performed on 12 airfoil-shaped coupons "foils" treated with the corrosion inhibiting composition comprising polyamines and 1 untreated foil. The "foils" were made from 17-4PH stainless steel and subjected to the same surface preening compressor airfoils receive. The foils were then cleaned with propanol to remove any residual oils. Six (6) of the 12 foils were immersed for 12 minutes in a corrosion inhibiting composition comprising 22 ppm of Formula 4 (see Table 2). The foils treated with Formula 4 were classified as "A group". Six (6) of the 12 foils were soaked in warm citric acid for 13 minutes, rinsed, then immersed for 16 minutes in a corrosion inhibiting composition comprising 22 ppm of Formula 5 (see Table 2). The foils treated with Formula 5 were classified as "B group". The last foil, the control, was cleaned with propanol to remove any residual oils, but was not subjected to any corrosion inhibition treatment.

Figure 15:
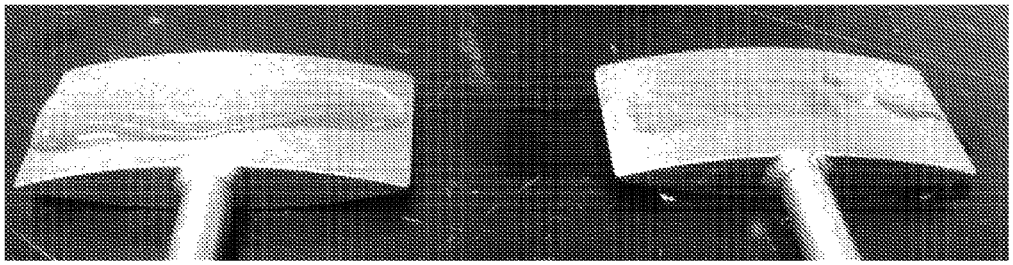
FIG. 15 is a photograph of the water bead test results on a Group "A" foil and a control foil.

Then, a water bead test was performed on all 13 foils. The water bead test comprised spraying each foil from left to right with a constant stream using a spray bottle filled with DI water. Each foil was then photographed. The control foil exhibited little to no water beading. The 12 treated foils exhibited more water beading than the control. FIG. 15 shows the water bead test results for two of the foils. The foil on the left is a foil from the A group that was treated with the corrosion inhibiting compositions and shows the water beading on the surface of the foil. The foil on the right is the control with no corrosion inhibition treatment and shows minimal water beading.

Figure 16:
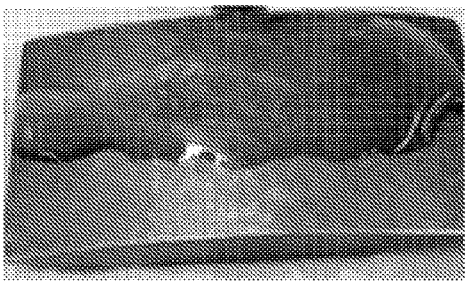
FIG. 16 is a photograph of the water bead test results on a Group "A" foil and a Group "B" foil before and after high velocity air tests.
Figure 16:
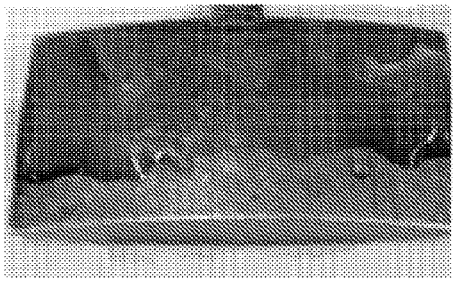
Figure 16:
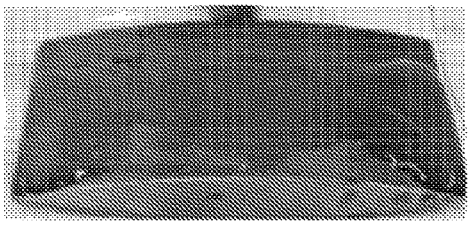
Figure 16:
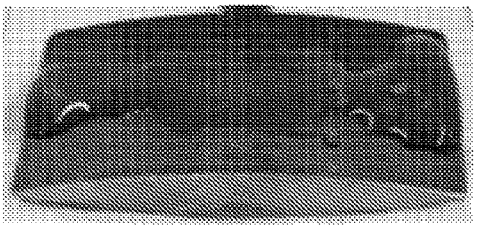
Figure 16:
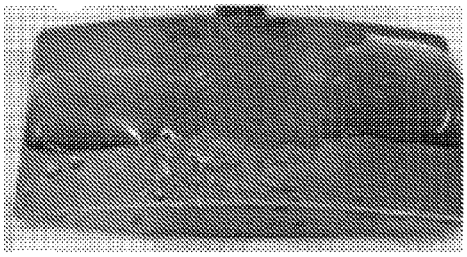
Figure 16:
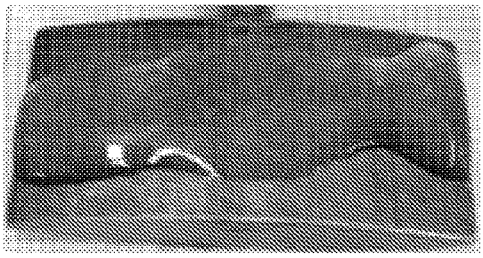

The foils were then loaded into an air flow calibration rig (Aerodyne Research, Inc. Billerica, Mass.). Each foil was loaded such that during air flow tests, one side for the foil was subjected to direct flow while the opposite side was shielded from flow. Each foil was subjected to a specific Mach number for 600±5 seconds. The test conditions included multiple attack angles and air velocities. After the Mach test, the foils were removed from the air flow calibration rig and a second water bead test was performed. The foils were again photographed and observed for signs of film degradation. FIG. 16 is an exemplary photograph of the water bead test result. The group on the left shows an "A group" foil before testing and after testing at a Mach number of 0.5 and orientated at an attack angle of 45°. The group on the right of FIG. 16 shows a "B group" foil before and after at a Mach number of 0.5 and orientated at an attack angle of 45°. Both the A group and B group foils show substantial water beading before and after the high velocity air flow tests. Table 4 shows the bead water test results for all the foils tested. Test results with a "✓" indicate no film degradation after the high velocity air tests as compared the bead test results before the foils were exposed to high velocity air. Test results with a "-" indicate film degradation.

TABLE 4

| Foil | Treatment | Mach No. | Angle to flow | Duration (min) | Film degradation (after $2^{nd}$ bead test) |
|---|---|---|---|---|---|
| 1A | polyamine blend | 0.5 | 45 | 10 | ✓ |
| 1B | acid clean, polyamine blend | 0.5 | 45 | 10 | ✓ |
| 2A | polyamine blend | 0.7 | 45 | 10 | ✓ |
| 2B | acid clean, polyamine blend | 0.7 | 45 | 10 | ✓ |
| 3A | polyamine blend | 0.9 | 45 | 10 | ✓ |
| 3B | acid clean, polyamine blend | 0.9 | 45 | 10 | ✓ |
| 4A | polyamine blend | 0.5 | 15 | 10 | — |
| 4B | acid clean, polyamine blend | 0.5 | 15 | 10 | — |

TABLE 4-continued

| Foil | Treatment | Mach No. | Angle to flow | Duration (min) | Film degradation (after $2^{nd}$ bead test) |
|---|---|---|---|---|---|
| 5A | polyamine blend | 0.7 | 15 | 10 | ✓ |
| 5B | acid clean, polyamine blend | 0.7 | 15 | 10 | ✓ |
| 6A | polyamine blend | 0.9 | 15 | 10 | ✓ |
| 6B | acid clean, polyamine blend | 0.9 | 15 | 10 | ✓ |
| Control | none | | | | NA |

Boiler Applications—Comparative Examples

Figure 17:
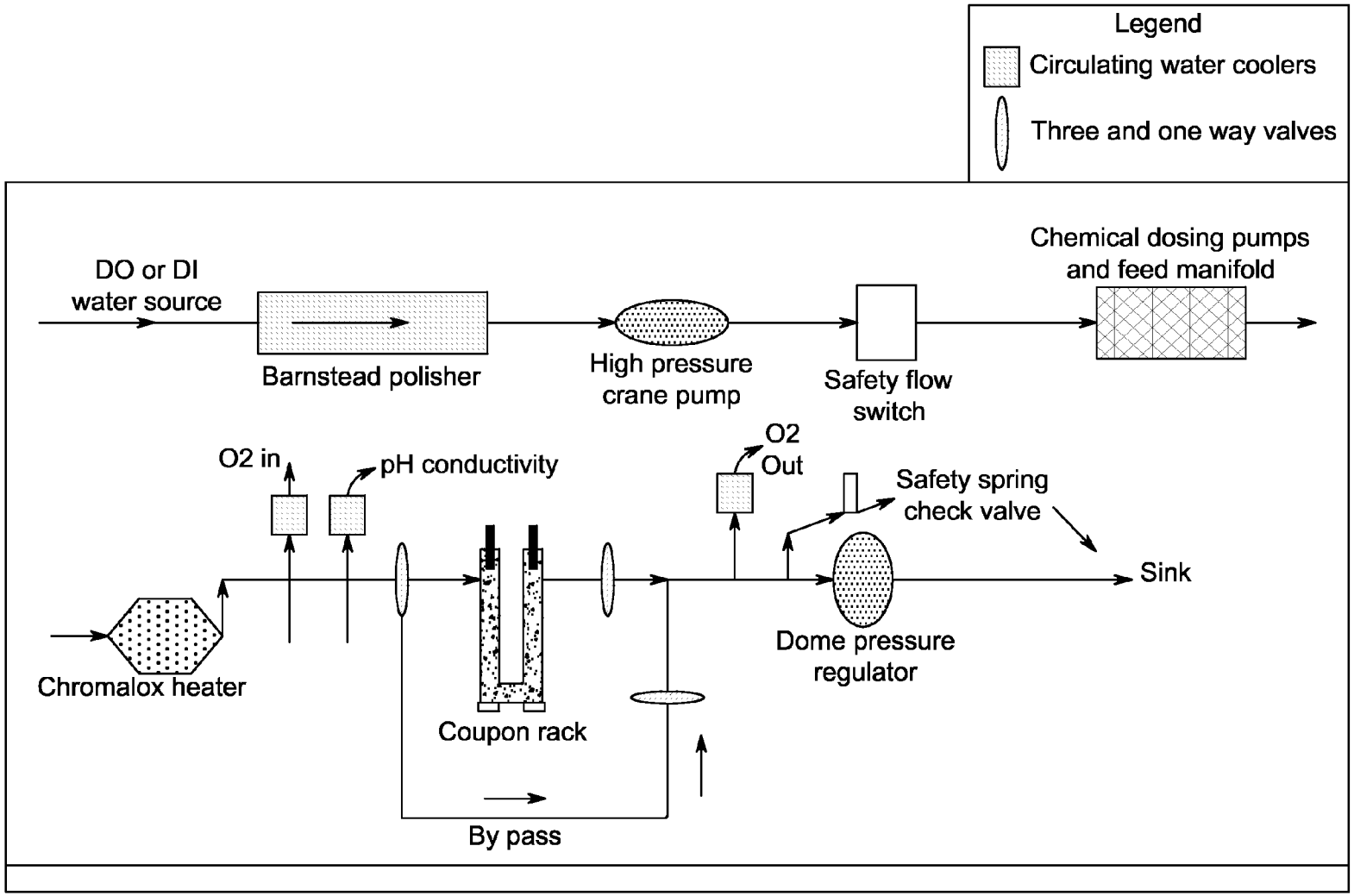
FIG. 17 is a schematic diagram of the corrosion apparatus used to test corrosion inhibiting compositions comprising filming amines (polyamines) under boiler conditions.

Experiments testing the performance of polyamines in boiler applications were performed. The experiments were completed using an experimental flow-through, corrosion test system apparatus. The apparatus consisted of a series of detectors, chemical dosing pumps, a high-pressure pump and a coupon rack holder. FIG. 17 is a schematic diagram of the flow-through test system. Corrosion was measured by placing test coupons in the apparatus and measuring the weight loss of each coupon.

All of the corrosion test apparatus components were of austenitic stainless steel construction, either Type 304 or 316. The apparatus could be connected to a source of deionized water (DI) or to deionized and deoxygenated water. The DI water had an oxygen content greater than 100 ppb. The deoxygenation was accomplished by membrane contactor cartridges. The deoxygenated water had an oxygen content of 8 to 12 ppb (mg/1) of oxygen, comparable to the water exiting a properly operating pressure deaerator. There was a mixed bed ion exchange polisher at the inlet of the apparatus. The high-pressure pump maintained a flow of 560 to 580 ml/min. A chemical manifold allowed the introduction of chemicals to obtain the water quality and the desired chemistry in the system. Chemical dosing pumps were Eldex® (Eldex Laboratories, Inc. Napa, Calif.) precision dosing pumps, and the treatment compositions (Comp 1, Comp 2, and Ex 2) were applied using an Isco HPLC injection pump (Teledyne Technologies, Inc., Lincoln, Nebr.). The temperature was achieved and maintained by a thermostatically on/off controlled, flow-through heater. The pressure in the apparatus was maintained at 120 psig (9.3 bar, 0.93 MPa). This pressure was, in all cases, above the saturated boiling pressure at the temperature of the system to assure that only a liquid phase (no steam) was present. The pressure in the system was kept constant by a high-flow dome pressure regulator.

The inlet dissolved oxygen, pH and conductivity were measured after the in-line heater in a cooled side stream sample. Thus, pH and conductivity were measured at room temperature. The coupon rack contained four coupons, and could be bypassed if needed while the system and chemical parameters were adjusted and equilibrated. In front of the dome pressure regulator, another cooled side stream sample was available for dissolved oxygen outlet measurements downstream of the corrosion coupon rack.

The concentration of oxygen was achieved by feeding aerated DI water into the deoxygenated water stream. A typical run started by establishing all the desired chemistry parameters at room temperature with the coupon rack being bypassed. The coupons were cleaned, weighed, and set in the coupon holders using Teflon washers to minimize galvanic corrosion. This measured weight was the initial coupon weight. Normally, in each run, there were four coupons—two of low carbon steel alloy (LCS), one of Admiralty brass alloy (ADM) and one Copper (Cu). The yellow metal coupons were located downstream of the steel coupons in the rack to avoid any potential copper plating on the low carbon steel.

High temperature Corrater® (Rohrback Cosasco Systems, Inc., Santa Fe Springs, Calif.) linear polarization probes were used for instantaneous corrosion determinations. One probe had LCS electrodes and the other ADM electrodes. It was noted during the course of the experiments that there was a lack of correlation between the instantaneous corrosion rate measurements made via the Corrater® instrument, and the gravimetric corrosion rates measured through standard coupon weight loss method. This was thought to be partially attributable to the relatively low conductivity of the test waters used.

The coupon rack was purged with nitrogen gas to eliminate air before the rack was incorporated into the test system. Using the bypass valves, the feedwater was allowed to flow through the coupon rack. The heater was set to the temperature of the run, and the system took 15 to 25 minutes to reach temperature. The standard exposure time for all runs, except for one set, was seven days. At a flow of 560 ml/min, the lineal velocity in the coupon rack was about 3.64 feet/minute (1.1 meter per minute).

After the coupons were exposed for seven days, the heater was disconnected and the apparatus was allowed to cool down with feedwater flow. Using the bypass valves the coupon rack was disconnected from the apparatus. The coupons were removed, rinsed with DI water and isopropanol, allowed to dry in air, photographed, cleaned and weighed. The weight after cleaning was the final coupon weight. Each of the runs was performed in duplicate. The reproducibility between duplicate runs was approximately 0.2 mpy (5.08 μm or 0.005 mm year) or slightly less.

The coupon weight before testing (initial weight) minus the weight after testing (final weight) was used to determine the coupon weight loss and calculate the corrosion rate in mils per year (mpy) in the standard manner.

The polyamine formulation (Ex 2) evaluated included the polyamine component, a blend of neutralizing amines to provide an alkaline media, and a small amount of synthetic polymeric dispersant. More specifically, Ex 2 comprised the same components as Formula 4 (see Table 2) therein, but at somewhat different ratios. Two benchmarks, or comparative examples (Comp 1 and Comp 2), were also tested. Comp 1 was an aqueous solution comprising 10 ppm of a traditional sodium sulfite treatment. Comp 2 was an aqueous solution comprising the same blend of neutralizing amines used in Ex 2.

The percent average corrosion rate difference (% Av Cor Diff) is defined as the average corrosion rate of the coupons in the benchmark treatment(s) (av B), minus the average corrosion rate of the coupons for the polyamine based product (av P), divided by the average corrosion for the benchmark(s), and the result multiplied by 100 according to formula (1) below.

$$\%\ \text{Av Cor Diff}=[(\text{av}B-\text{av}P)/\text{av}B]\times 100 \quad (1)$$

As defined by equation (1), if the % Av Cor Diff is positive, then the polyamine product produced less corrosion in the coupons than the benchmark(s). If the % Av Cor Diff is negative, then the polyamine product produced more corrosion in the coupons than the benchmark(s).

Since the benchmarks and the polyamine runs were duplicated each average considers all the corrosion results from each duplicate. Therefore, the LCS results averaged four coupons' corrosion rates, the ADM and the Cu results averaged two coupons each.

A very stringent set of feedwater conditions using softened quality water, 1000 ppb (μg/l) of dissolved oxygen at a temperature of 85° C. (185° F.) was tested to simulate an industrial low-pressure boiler feedwater. The softened quality water was composed of 0.2 ppm (mg/1) Ca as $CaCO_3$, 0.1 ppm (mg/1) Mg as $CaCO_3$, 5 ppm of silica as $SiO_2$, and 50 ppm M alkalinity as $CaCO_3$. The room temperature conductivity of this simulated water was approximately 100 $\mu Scm^{-1}$.

Corrosion results for this feedwater are presented in Table 5. Only the Comp 1 benchmark comprising sodium sulfite oxygen scavenger treatment, resulted in corrosion rates lower than 1.5 mpy (0.0381 mm/y) for LCS and lower than 0.6 mpy (0.015 mm/y) for ADM. All the copper coupons had corrosion rates below 0.5 mpy (0.0127 mm/y) for the benchmarks and the polyamine-based product. In other words, there was no difference in the corrosion of copper among the treatments in this simulated softened feedwater condition.

TABLE 5

Percent average corrosion rate difference for softened feedwater. 1000 ppb (μg/l) of oxygen, 85° C. (185° F.)

| Benchmark | Average Corrosion Rate | Polyamine blend (Ex 2) | Average Corrosion Rate | % Av Cor Diff LCS | % Av Cor Diff ADM |
|---|---|---|---|---|---|
| Comp 1 - Inorganic oxygen scavenger, $Na_2SO_3$, 10 ppm (mg/1) | Comp 1 1.27 mpy (32.3 μm/y) | 40 ppm (mg/l) | Ex 2 6.1 mpy (155 μm/y) | −349 | −172 |
| Comp 2 - 40 ppm (mg/l) neutralizing amines | Comp 2 14 mpy (356 μm/y) | 40 ppm (mg/l) | Ex 2 6.1 mpy (155 μm/y) | 59 | −36 |

Note that the dissolved oxygen concentration in the systems with Comp 2 and the polyamine product (Ex 2) was 1000 ppb whereas, in Comp 1, with the traditional sodium sulfite treatment, the dissolved oxygen was reduced to 12 ppb (μg/l) and the pH was approximately 9.

From the results shown in Table 5, it is clear that the polyamine product did not provide corrosion protection of carbon steel comparable to that provided by a traditional sodium sulfite treatment at the same feedwater pH with an identical amine blend. This high dissolved oxygen condition of 1000 ppb (μg/l) as $O_2$ was intended to simulate a low-pressure boiler feedwater in the absence of a pressure deaerator.

Figure 18:
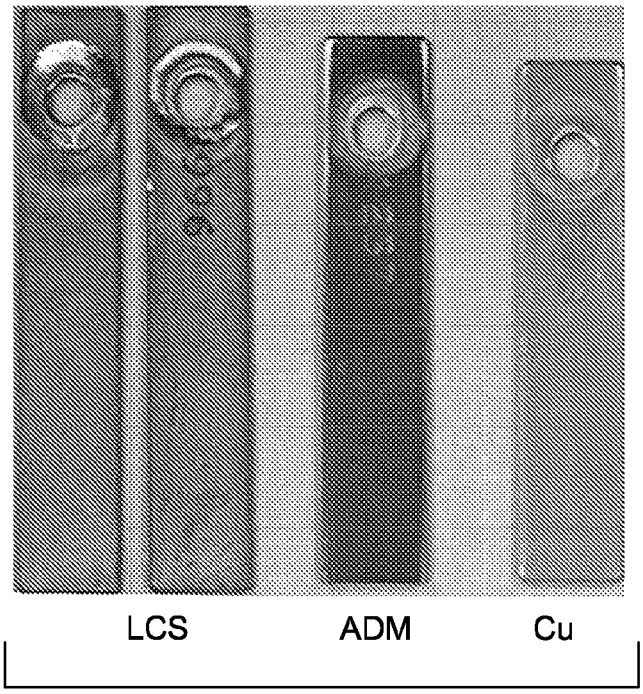
FIG. 18 is a photograph of the coupons treated with the traditional sodium sulfite treatment after corrosion testing.
Figure 19:
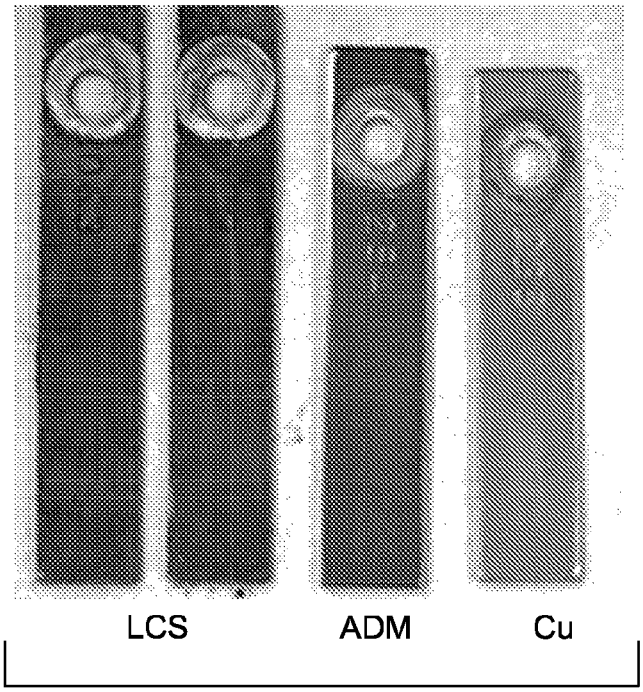
FIG. 19 is a photograph of the coupons treated with Comp 2 (neutralizing amines only) in the presence of 1000 ppb of dissolved $O_2$.

A photograph of the coupons treated with the traditional sodium sulfite treatment after corrosion testing is shown in FIG. 18. As may be seen in FIG. 18, the coupons treated with the traditional sodium sulfite treatment show very little visible corrosion. The average corrosion rates for the coupons in FIG. 18 was about 1.27 mpy or about 32.3 μm/y. A photograph of the coupons treated with Comp 2 (neutralizing amines only) in the presence of 1000 ppb of dissolved $O_2$ is shown in FIG. 19. The coupons shown in FIG. 19 show substantial amounts of corrosion. The average corrosion rates for the coupons in FIG. 19 was about 14 mpy or about 356 μm/y.

Figure 20:
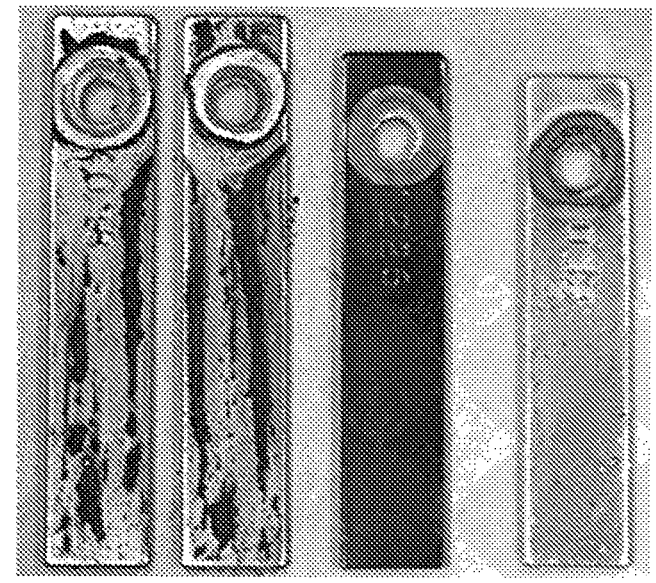
FIG. 20 is a photograph of the coupons treated with Ex 2 in the presence of 1000 ppb of dissolved $O_2$.

A photograph of the coupons treated with Ex 2 in the presence of 1000 ppb of dissolved $O_2$ is shown in FIG. 20. The LCS coupons for both the polyamine product and Comp 2 showed streaked surfaces and in the streaked areas, pits. It appears the polyamine blend Ex 2 negatively affected the corrosion rate of ADM versus Comp 2. Although the polyamine treatment, as shown in Table 5, decreased the low carbon steel corrosion rate by 59% versus the Comp 2 benchmark, there was still a significantly higher corrosion rate on carbon steel versus the traditional sulfite scavenger treatment. The average corrosion rates for the coupons treated with Ex 2 and shown in FIG. 20 was about 6.1 mpy or about 155 μm/y. This result would indicate that there are limits of tolerance in terms of feedwater dissolved oxygen levels with polyamine treatment, and that it would not be advisable to apply the polyamine treatment in the absence of a properly operating pressure deaerator. Moreover, the average corrosion rates for the coupons treated with Comp 2 and Ex 2 exhibited unacceptably high corrosion for boiler applications, and the corrosion rates exhibited would have also been unacceptable for gas turbine air compressor applications.

Thus, one skilled in the art of boiler water treatment would not expect the polyamine blends to work well in applications where the metal surfaces would be exposed to high levels of dissolved oxygen. This includes gas turbine air compressor applications wherein the turbines are operated in ambient conditions and where any liquid present on the gas turbine alloys would be fully oxygenated. In the boiler corrosion tests described in Table 5 and FIG. 19 above, the dissolved oxygen level was controlled at 1000 ppb (1 ppm), which would be considered a very high dissolved oxygen level in a boiler system, indicating either an improperly operating deaerating heater, or the absence of deaeration equipment. In comparison, the fully aerated water films formed under ambient temperature, atmospheric conditions on gas turbine air compressors would typically contain dissolved oxygen levels between 7,000 and 10,000 ppb (7 and 10 ppm), depending on the specific temperature and atmospheric pressure. Surprisingly, however, the polyamine blends worked well in the laboratory testing simulating fully aerated gas turbine air compressor conditions using two coupled multi-electrode array ("CMA") probes. Turning back now to FIG. 11, the average corrosion rates generally less than about 10 μm/y after the polyamine treatment, and in some cases significantly less. The corrosions rates of the polyamine treated coupons in the boiler applications, however, were at least on order of magnitude greater.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of inhibiting corrosion or metal surfaces of gas turbine air compressors by contacting said metal surfaces with a corrosion inhibiting composition, said composition having the formula

| Polyamine blend | Range (wt %) |
|---|---|
| cyclohexylamine | 0-40 |
| morpholine | 0-15 |
| monoethanolamine | 7-30 |
| N,N-dimethylaminopropylamine | 0-50 |
| N,N-diethylaminoethanol | 0-15 |
| (Z)-N-9-octadecenyl-1,3-propanediamine | 5-20 |
| (Z)-9-octadecene-1-amine | 1-5 |
| demineralized or deionized water | Balance (0-65). |

2. The method of claim 1, wherein said metal surfaces are exposed to moisture and/or water and/or an aqueous solution during and/or after treatment, and wherein said moisture and/or water and/or an aqueous solution has about 1,000 to 10,000 parts-per-billion (ppb by weight) of dissolved oxygen ($O_2$) therein.

3. The method of claim 1, wherein the method further comprises contacting said metal surfaces with a citric acid solution before contacting said metal surfaces with said composition.

4. The method of claim 3, wherein the method further comprises rinsing said metal surfaces with water after contacting said surfaces with said citric acid solution and before contacting said metal surfaces with said composition.

* * * * *